US012285117B2

(12) United States Patent
Tyneski et al.

(10) Patent No.: US 12,285,117 B2
(45) Date of Patent: Apr. 29, 2025

(54) MODULAR BASSINET / BEDSIDE SLEEPER

(71) Applicant: Kids2, LLC, Atlanta, GA (US)

(72) Inventors: Frank M. Tyneski, Roswell, GA (US); John A. McMillan, Lilburn, GA (US); Alexander Padgett, Atlanta, GA (US)

(73) Assignee: Kids2, LLC, Atlanta, GA (US)

( * ) Notice: Subject to any disclaimer, the term of this patent is extended or adjusted under 35 U.S.C. 154(b) by 148 days.

(21) Appl. No.: 17/747,582

(22) Filed: May 18, 2022

(65) Prior Publication Data

US 2022/0330715 A1 Oct. 20, 2022

Related U.S. Application Data

(63) Continuation-in-part of application No. 29/784,562, filed on May 20, 2021, now abandoned, and a continuation-in-part of application No. 29/778,859, filed on Apr. 15, 2021, now abandoned.

(60) Provisional application No. 63/240,601, filed on Sep. 3, 2021, provisional application No. 63/189,783, filed on May 18, 2021.

(51) Int. Cl.
*A47D 11/00* (2006.01)
*A47D 9/00* (2006.01)

(52) U.S. Cl.
CPC ..... *A47D 11/007* (2013.01); *A47D 9/012* (2022.08)

(58) Field of Classification Search
None
See application file for complete search history.

(56) References Cited

U.S. PATENT DOCUMENTS

| | | | |
|---|---|---|---|
| 1,266,927 | A | 5/1918 | Eberle |
| 2,698,442 | A | 1/1955 | Travis |
| 3,044,078 | A | 7/1962 | Hamilton |
| 3,127,620 | A | 4/1964 | Peterson |
| 3,146,736 | A | 9/1964 | Hetrick |
| 3,162,460 | A | 12/1964 | Davidson |
| 3,162,865 | A | 12/1964 | Tigrett |
| 3,309,719 | A | 3/1967 | Bader et al. |
| 3,504,927 | A | 4/1970 | Showa et al. |
| 3,763,507 | A | 10/1973 | Propst |
| 3,789,439 | A | 2/1974 | Berg et al. |
| 4,019,756 | A | 4/1977 | Ishida |
| 4,044,931 | A | 8/1977 | Catelli |

(Continued)

FOREIGN PATENT DOCUMENTS

EP 3085574 A1 10/2016

*Primary Examiner* — Adam C Ortiz
(74) *Attorney, Agent, or Firm* — Perilla Knox & Hildebrandt LLP; Stephanie L. Davy-Jow

(57) ABSTRACT

A children's accessory including a frame and a containment portion supported by the frame. In some example forms, the frame is adjustable between a lower first height and a higher second height relative to a supporting surface. In some example forms, the containment portion is adjustable between a shallower first depth and a deeper second depth. In some example forms, the containment portion further comprises a bedside sleeper flap configured to be opened or closed for side access to the containment portion. In some example forms, the accessory is reconfigurable between two or more configurations, such as for example a bassinet configuration, a bedside sleeper configuration and a playard configuration. In some example forms, the frame includes at least one modular frame component.

5 Claims, 16 Drawing Sheets

(56) References Cited

U.S. PATENT DOCUMENTS 4,070,716 A 1/1978 Satt
4,499,619 A 2/1985 Kassai
4,503,943 A 3/1985 Tsukui
4,715,075 A 12/1987 Shamie
4,822,030 A 4/1989 Cone
4,932,086 A 6/1990 Bergkvist
5,172,435 A 12/1992 Griffin et al.
5,193,234 A 3/1993 Joaquin
5,293,655 A 3/1994 Vanwinkle et al.
5,662,344 A 9/1997 Lu
D398,161 S 9/1998 Rosenbaum
5,813,720 A 9/1998 Huang
5,845,349 A 12/1998 Tharalson et al.
5,957,436 A 9/1999 Ristau
5,970,539 A 10/1999 McDermott, Jr. et al.
6,048,290 A 4/2000 Chen et al.
6,076,839 A 6/2000 Pao-Hung
6,112,347 A 9/2000 Tharalson et al.
6,148,456 A 11/2000 Tharalson et al.
6,202,228 B1 3/2001 Cox
6,260,867 B1 7/2001 Yang et al.
6,339,855 B1 1/2002 Socha et al.
6,494,815 B1 12/2002 Welsh, Jr.
6,550,082 B2 4/2003 Tharalson et al.
6,578,211 B2 6/2003 Tharalson et al.
6,588,033 B1 7/2003 Welsh, Jr. et al.
6,687,928 B1 2/2004 Wilson
6,704,949 B2 3/2004 Waldman et al.
6,859,957 B1 3/2005 Chen
6,859,958 B2 3/2005 Lamantia
6,862,757 B2 3/2005 Andriunas et al.
6,863,287 B2 3/2005 Myers et al.
6,877,173 B2 * 4/2005 Tharalson ..... A47D 13/063 5/98.1
6,907,626 B1 6/2005 Welsh, Jr. et al.
6,920,830 B1 7/2005 Asbach et al.
6,931,677 B2 8/2005 Tharalson et al.
6,934,981 B2 8/2005 Waldman et al.
6,952,846 B2 10/2005 Flannery et al.
7,013,505 B2 3/2006 Martin
7,013,508 B2 3/2006 Wu
7,017,924 B1 3/2006 Lambert
7,028,353 B2 4/2006 Waldman et al.
RE39,136 E 6/2006 Tharalson et al.
7,055,194 B2 6/2006 Arthur
7,137,158 B2 11/2006 Flannery
7,178,184 B2 2/2007 Flannery
7,181,788 B2 2/2007 Flannery
7,216,379 B2 5/2007 Tharalson et al.
7,287,768 B2 10/2007 Myers et al.
7,302,720 B2 12/2007 Flannery
7,373,679 B2 5/2008 Miller
7,376,987 B2 5/2008 Barnes
7,406,725 B2 8/2008 Martin et al.
7,415,739 B2 8/2008 Tharalson et al.
7,526,821 B2 5/2009 Chen et al.
7,591,031 B2 9/2009 Yang
7,640,606 B2 1/2010 Flannery et al.
7,752,688 B2 7/2010 Chen et al.
7,770,245 B2 8/2010 Cheng et al.
7,818,832 B2 10/2010 Hartenstine et al.
7,913,333 B2 3/2011 Flannery et al.
8,162,333 B1 4/2012 Bartlett
8,209,798 B2 7/2012 Schwartz et al.
8,302,978 B2 11/2012 You et al.
8,308,239 B2 11/2012 Lundeen
RE43,919 E 1/2013 Chen
8,429,771 B2 4/2013 Long
8,458,831 B2 6/2013 Flannery et al.
8,505,136 B2 8/2013 Yu et al.
8,555,436 B2 10/2013 Flannery et al.
8,656,530 B2 2/2014 You et al.
8,677,526 B2 3/2014 Li
8,726,433 B1 5/2014 Flannery et al.
8,745,780 B2 6/2014 Su
8,756,728 B2 6/2014 Bergkvist
8,844,072 B2 9/2014 Bellows et al.
8,966,682 B1 3/2015 Flannery et al.
9,021,629 B2 5/2015 Cheng
9,027,180 B2 5/2015 Troutman
9,138,070 B1 9/2015 Shamie et al.
9,155,400 B1 10/2015 Flannery et al.
9,179,786 B1 11/2015 Ransil et al.
9,265,353 B1 2/2016 Flannery et al.
9,357,854 B2 6/2016 Sundberg et al.
9,549,619 B2 1/2017 Hashiba
9,565,950 B2 2/2017 Horst et al.
9,622,593 B2 4/2017 Longenecker et al.
D804,217 S 12/2017 Festa
9,883,750 B2 2/2018 Yi
9,908,551 B2 3/2018 Ransil
9,918,564 B2 3/2018 Paterson
9,962,012 B1 5/2018 Schmid et al.
D826,593 S 8/2018 Kuo
10,039,389 B2 8/2018 Yang
10,117,524 B1 11/2018 Flannery et al.
10,149,551 B2 12/2018 Long
10,149,552 B2 12/2018 Longenecker et al.
10,154,737 B2 12/2018 Horst et al.
10,172,479 B2 1/2019 Horst et al.
10,383,455 B2 8/2019 Sclare
10,383,457 B2 8/2019 Crumrine
10,407,089 B1 9/2019 Matranga
10,413,088 B2 9/2019 Curtis
10,477,982 B2 11/2019 Damiani
10,492,623 B2 12/2019 Troutman
10,674,837 B1 6/2020 Flannery et al.
10,694,866 B2 6/2020 Gallina
10,722,047 B2 7/2020 Gallina
10,827,849 B1 11/2020 Flannery et al.
D905,462 S 12/2020 Jeidel et al.
10,874,225 B2 12/2020 Horst et al.
D913,025 S 3/2021 Mu
10,932,590 B1 3/2021 Flannery et al.
11,202,519 B1 * 12/2021 Flannery ..... A47D 9/005
2002/0164917 A1 11/2002 Keegan et al.
2003/0061657 A1 4/2003 Longenecker et al.
2003/0177575 A1 9/2003 Cheng et al.
2005/0241064 A1 11/2005 Lopes
2005/0262629 A1 12/2005 Cheng et al.
2006/0000019 A1 1/2006 Martin
2006/0037140 A1 2/2006 Clute
2006/0162075 A1 7/2006 Waldman et al.
2006/0230528 A1 10/2006 Church
2007/0017025 A1 1/2007 Myer
2007/0251005 A1 11/2007 Tharalson
2007/0271697 A1 11/2007 Martin
2008/0001450 A1 1/2008 Yang
2008/0010742 A1 1/2008 Tharalson
2008/0282468 A1 11/2008 Golias et al.
2009/0064409 A1 3/2009 Carpenter et al.
2010/0078909 A1 4/2010 Cheng
2010/0132115 A1 6/2010 Hsu
2010/0263121 A1 10/2010 Arnold, IV et al.
2011/0113549 A1 5/2011 Riddiford et al.
2011/0187080 A1 * 8/2011 Wallace ..... B60B 33/0018 16/45
2011/0308011 A1 12/2011 Cheng et al.
2013/0133136 A1 5/2013 Cheng
2013/0145546 A1 6/2013 Cheng
2013/0145547 A1 6/2013 Su
2013/0212804 A1 8/2013 Petrucci
2013/0326809 A1 12/2013 Jacobs et al.
2014/0101847 A1 4/2014 Von Rohrscheidt et al.
2015/0366372 A1 12/2015 Lei et al.
2016/0135608 A1 * 5/2016 Hashiba ..... A61G 7/0525 5/427
2016/0286979 A1 * 10/2016 Sclare ..... A47D 9/016
2017/0238721 A1 8/2017 Damiani
2017/0251827 A1 9/2017 Gallina
2018/0146796 A1 5/2018 Longenecker et al.
2018/0192785 A1 7/2018 Horst et al.
2018/0206651 A1 7/2018 Gallina
2018/0206652 A1 7/2018 Gallina

(56) References Cited

U.S. PATENT DOCUMENTS

| | | | |
|---|---|---|---|
| 2018/0319214 | A1* | 11/2018 | Renno ..... B60B 33/0057 |
| 2018/0332977 | A1 | 11/2018 | Sozzo |
| 2019/0045944 | A1 | 2/2019 | Yang |
| 2019/0099012 | A1 | 4/2019 | Zhang et al. |
| 2019/0246802 | A1 | 8/2019 | Dacks et al. |
| 2019/0254442 | A1 | 8/2019 | Tuckey |
| 2019/0254443 | A1 | 8/2019 | Longenecker et al. |
| 2020/0046141 | A1 | 2/2020 | Mu |
| 2020/0383494 | A1 | 12/2020 | Mu |
| 2021/0145186 | A1 | 5/2021 | Mu |

* cited by examiner

MODULAR BASSINET / BEDSIDE SLEEPER

CROSS-REFERENCE TO RELATED APPLICATIONS

This application claims the priority benefit of U.S. Provisional Patent Application Ser. No. 63/189,783 filed May 18, 2021, and U.S. Provisional Patent Application Ser. No. 63/240,601 filed Sep. 3, 2021; and claims priority as a continuation-in-part of U.S. Design Patent Application Ser. No. 29/778,859 filed Apr. 15, 2021, and a continuation-in-part of U.S. Design Patent Application Ser. No. 29/784,562, filed May 20, 2021, the entireties of which are all hereby incorporated herein by reference for all purposes.

TECHNICAL FIELD

The present disclosure relates generally to the field of children's accessories, and more particularly to a children's accessory that is convertible or adjustable for use in different configurations including for example as a bassinet, a bedside sleeper, and/or a play yard.

BACKGROUND

Children's accessories such as bassinets, bedside sleepers, and/or play yards are often configured for particular uses and particular stages of a child's development. As a child grows, such limited or single-purpose accessories may no longer be useful, requiring parents to store or dispose of outgrown products and purchase new products suited for the child's stage of development. This may result in undesired waste, inconvenience and expense. Also, limited or single-purpose accessories may require parents to purchase and maintain multiple different accessories for different purposes, also undesirably adding to expense and space requirements.

It is to the provision of children's accessories that are convertible between different modes of use, for different purposes, and/or suited to different stages of childhood development that the present disclosure is primarily directed.

SUMMARY

In example embodiments, the present disclosure relates to children's accessories that are convertible or adjustable for use in different configurations including for example as a bassinet, a bedside sleeper, and/or a playard. In further examples, the present disclosure relates to children's accessories that are convertible or adjustable for use in modes suited for different stages of childhood development or children of different ages and/or sizes. In further examples, the present disclosure relates to children's accessories that are of modular construction, having multiple parts or components of like configuration and/or sharing part configurations with other products, for efficiency and economy in product design, manufacture and assembly.

In one aspect, the present disclosure relates to a children's accessory for supporting a child over a support surface. The children's accessory comprises a frame and a child containment portion. The child containment portion is preferably supported by the frame. The children's accessory is also preferably reconfigurable between a bassinet configuration, a bedside sleeper configuration, and a playard configuration.

Optionally, the children's accessory is adjustable between a first, lowered height and a second, higher height relative to the support surface.

Optionally, the child containment portion is adjustable between a first, shallower depth and a second, deeper depth. Additionally, the child containment portion may be in contact with the support surface when the child containment portion is adjusted to the second, deeper depth.

Optionally, the child containment portion comprises a beside sleeper flap configured to be opened or closed for side access to the child containment portion.

Optionally, the children's accessory further comprises one or more bedside securing straps for securing the children's accessory adjacent to a bed, wherein the one or more bedside securing straps comprise a first strap portion for facilitating first adjustments and a second strap portion for facilitating second adjustments. Additionally, at least one of the one or more bedside securing straps may comprise two distinct portions for making two separate adjustments and a L-shaped anchor.

Optionally, the children's accessory further comprises at least one wheel assembly, the at least one wheel assembly comprising a spring-biased hinged flange and a wheel pivotally secured to the spring-biased hinged flange.

In another aspect, the present disclosure relates to a securing device for securing an accessory to a parental bed. The securing device comprises a first portion for making first adjustments and a second portion for making second adjustments separate from the first adjustments.

Optionally, the first portion comprises a first strap and a L-bracket at a first end of the first strap.

Optionally, the second portion comprises a second strap and a side-release clip.

Optionally, the first and second portions are separable from one another.

In still another aspect, the present disclosure relates to a child support furniture comprising a lower frame assembly with a fixed height and comprising at least one channel, and an upper frame assembly comprising at least one frame post. The at least one frame post of the upper frame assembly is preferably slidably engaged in the at least one channel of the lower frame assembly. The upper frame assembly is preferably adjustable between a first height and a second height relative to the lower frame assembly.

Optionally, the child support furniture further comprises a child enclosure unit detachably secured to the upper frame assembly. Additionally, the child enclosure unit may be adjustable between a first depth and a second depth different from the first depth. Still additionally, the child enclosure unit may comprise at least one first engagement element and at least one second engagement element wherein the child enclosure unit comprises the first depth when the at least one first engagement element is coupled to the at least one second engagement element and the child enclosure unit comprises the second depth when the at least one first engagement element is detached from the at least one second engagement element.

In yet another aspect, the present disclosure relates to a wheel assembly for an accessory. The wheel assembly comprises a hinged outrigger flange coupled to a frame member of the accessory and at least one wheel coupled to the hinged outrigger flange.

Optionally, the hinged outrigger flange may be spring biased toward an oblique angular offset orientation relative to the frame member.

Optionally, the at least one wheel may be a caster wheel pivotally mounted to the hinged outrigger flange.

Optionally, the at least one wheel may comprise a releasable locking mechanism configured for user actuation to selectively allow or prevent rolling of the wheel.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1B:
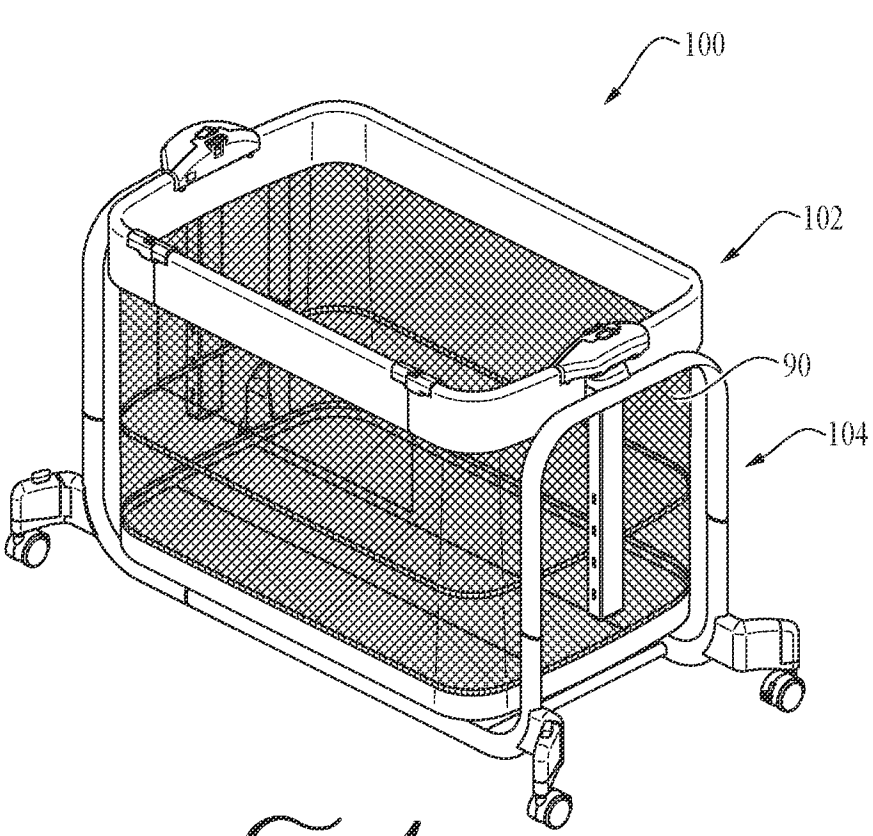
FIG. 1B shows an example embodiment of a modular children's accessory according to the present disclosure in a playard configuration.
Figure 1A:
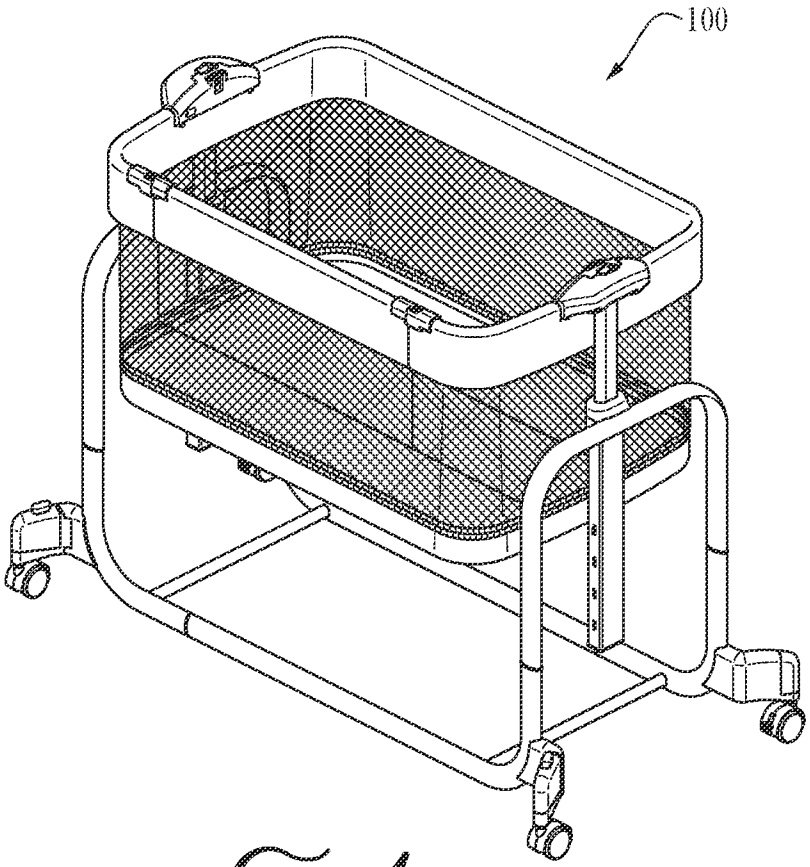
FIG. 1A shows an example embodiment of a modular children's accessory according to the present disclosure in a bassinet configuration.
Figure 1C:
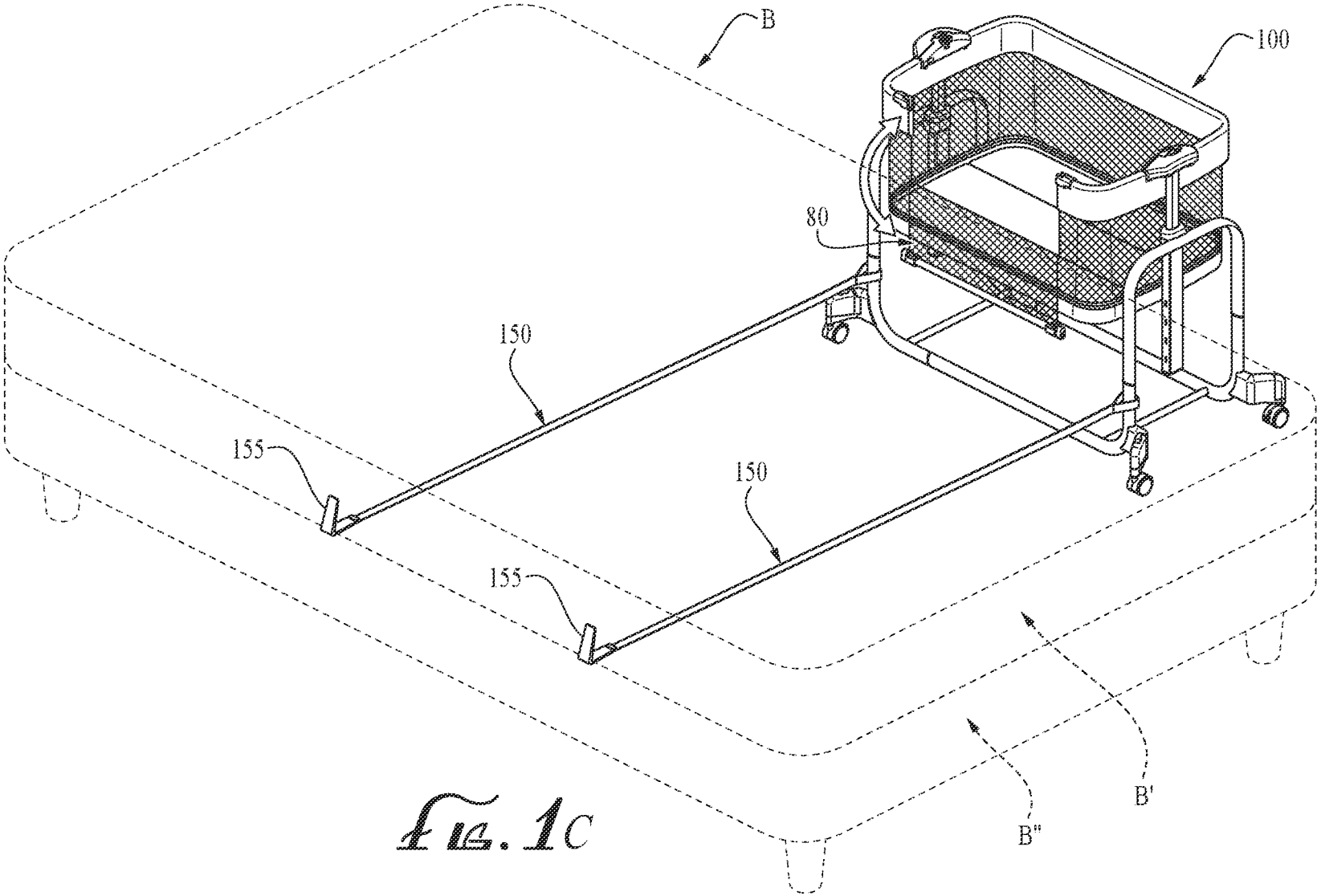
FIG. 1C shows an example embodiment of a modular children's accessory according to the present disclosure in a bedside sleeper.

With reference now to the drawing figures, wherein like reference numbers represent corresponding parts throughout the several views, FIGS. 1A-1C show a children's accessory or furniture 100 according to an example embodiment of the present disclosure, adjusted to different configurations suited to different purposes or modes of use, and/or to different stages of child development. For example, FIG. 1A shows the children's accessory 100 in a raised bassinet configuration. In the bassinet configuration, the depth (i.e., measured from top to bottom) of the child containment portion 90 is between about 10 inches to about 20 inches, or more preferably between about 12 inches to about 18 inches. Typically, the shallower enclosure depth and lower sidewalls in the bassinet configuration make it easier for parents and caretakers to move a child in and out of the enclosure.

FIG. 1B shows the children's accessory 100 in a playard configuration. In the playard configuration, the child containment portion 90 is expanded or enlarged to provide a deeper enclosure than in the bassinet configuration by lowering the floor of the child containment portion. In example embodiments, the depth (i.e., measured from top to bottom) of the child containment portion 90 in the playard is between about 20 inches to about 32 inches, or more preferably between about 24 inches to about 28 inches. The greater depth of the child containment portion reduces the risk of children climbing or falling out of the containment portion 90 as they develop and learn to crawl and stand. In example embodiments, the distance between the floor of the child containment portion 90 in the playard configuration and the support surface (e.g., ground, floor, etc.) can be as little as 0 in., such that the floor of the playard rests on or in contact with the underlying floor or other support surface to provide a more stable and firm support for a child learning to stand.

FIG. 1C shows the children's accessory 100 in a bedside sleeper configuration. In the bedside sleeper configuration, the floor of the containment portion 90 is preferably raised and the bedside flap 80 is lowered or removed. Preferably, the children's accessory 100 is also provided with one or more bedside securing straps 150 to secure the children's accessory 100 next to and/or partially over for example a parental bed B. Generally, a first end of the securing strap 150 is secured to a portion of the children's accessory 100 (preferably the frame) and the other end of the securing strap 150 is secured to the bed. In example embodiments, the securing strap 150 includes an adjustment mechanism for tightening or shortening the securing strap in order to pull the children's accessory closer to the bed and minimize any gap therebetween. Preferably, the gap between the children's accessory 100 and the parental bed is less than about 1 inch, and more preferably no more than about 0.5 in., to prevent the child or parts of the child's body from falling or getting stuck between the bedside sleeper and the adult bed; and in further example embodiments, the bedside sleeper is maintained in direct contact against the adult bed with no gap therebetween. In the bedside sleeper configuration, the children's accessory 100 provides a safe, isolated area for the child or infant to sleep next to for example a parent or caretaker without sharing the bed with the parent or caretaker. The bedside opening defined by the removal of bedside flap 80 also provides the parent or caretaker quick and easy access to the child from the bed.

Generally, the children's accessory 100 includes a structural frame including an upper frame assembly 102 and a base frame assembly 104 configured to rest on a support surface (i.e., ground or floor). The structural frame is adjustable between a first, lowered height or position and a second, higher height or position relative to the support surface. In example embodiments, the lower frame assembly 104 has a fixed height and comprises at least one channel for receiving and supporting the upper frame assembly 102. The upper frame assembly 102 includes at least one frame post or frame support column for slidably engaging the at least one channel of the lower frame assembly 104. Accordingly, the upper frame assembly 102 is slidably moveable or adjustable relative to the lower frame assembly 104 and/or the support surface. For example, in example embodiments, the upper frame assembly is adjustable between a first, lower height and a second, higher height. In other example embodiments, the upper frame assembly 102 may be adjustable between three or more different predetermined heights.

Preferably, the children's accessory 100 includes one or more wheels secured to the lower frame assembly 104 allowing the children's accessory to be moved around the support surface with less effort. In example embodiments, the children's accessory 100 includes one or more hinging wheel assemblies 140. The hinging wheel assemblies 140 generally include spring-biased hinged flanges and wheels pivotally secured to the hinged flanges. In a neutral state, the hinged flanges are spring biased toward an outwardly oblique angular offset orientation relative to the lower frame assembly 104. The outward offset orientation provides greater stability to the children's accessory and clearance for lowering the containment portion 90. Moreover, the hinging wheel assemblies 140 can be unlocked to pivot or hinge to a retracted position, for example aligned with the frame element to which it is attached, upon contact or abutment with another object such as for example a frame of the parental bed, in order to allow the bedside sleeper to be pulled against or in closer proximity to the adult bed than fixed-position caster wheel assemblies might otherwise permit.

The children's accessory 100 generally further includes a child containment portion or enclosure unit 90 configured for receiving an infant or small child therein. In typical example embodiments, the child containment portion 90 comprises a soft-goods liner comprising a floor or base portion and a plurality of peripheral walls. In example embodiments, the top of the containment portion is open (i.e., not covered).

The child containment portion 90 may further comprise one or more engagement elements configured for increasing and decreasing the depth of the child containment portion. For example, the child containment portion 90 comprises a first engagement element(s) (e.g., a first side of a zipper closure, a button, a male portion of a snap fastener, etc.) arranged along the sidewalls at least some distance apart from the floor and a second engagement element(s) (e.g., a second side of a zipper closure, a loop or slit, a female portion of a snap fastener, etc.) arranged along the perimeter of the floor. The second engagement element is configured for detachably engaging the first engagement element(s). In example embodiments, the depth of the containment portion 90 can be decreased by raising the floor of the containment portion 90 up to first engagement element(s) and fastening the second engagement element(s) to the first engagement element(s). Conversely, the depth of the containment portion 90 can be increased by disengaging the second engagement element(s) from the first engagement element(s) and allowing the floor of the containment portion to fall or be lowered.

The child containment portion 90 may further comprise one or more displaceable panels or flaps configured to be opened and closed (or detached and attached) to provide another point of access to the child or infant inside the child containment portion during use. For example, in the bedside sleeper configuration, it is preferable to have access to the child via a side of the containment portion and without having to reach over the sidewalls, for example to calm or feed a baby at night. In example embodiments, the height of the displaceable flap is between about 9 inches to about 16 inches, or more preferably between about 8 inches to about 12 inches.

The children's accessory 100 may optionally include a canopy or cover (not shown) provided over the childing containment portion 90 and configured for covering at least a portion of the child containment portion. Optionally, the canopy may also include operable lights (e.g., string lights) embedded in or attached to the canopy to provide decorative and/or functional illumination over the child containment portion 90. Preferably, the lights are battery operated but may be configured for use with other power sources.

In example embodiments, the child containment portion 90 is removably attached or secured to the upper frame assembly 102. In example embodiments, the child containment portion or enclosure 90 comprises a soft-goods liner removably attached to the upper frame assembly 102 and suspended therefrom. The soft-goods liner is preferably formed of a fabric, sheeting or other flexible material (with or without padding). The soft goods liner may comprise one or more portions formed from a mesh lining to provide better airflow and allow visual observation of a child in the containment portion through the mesh liner material. For example, in the depicted embodiments, all four walls of the child containment unit 90 are entirely of mesh lining material.

Figure 1D:
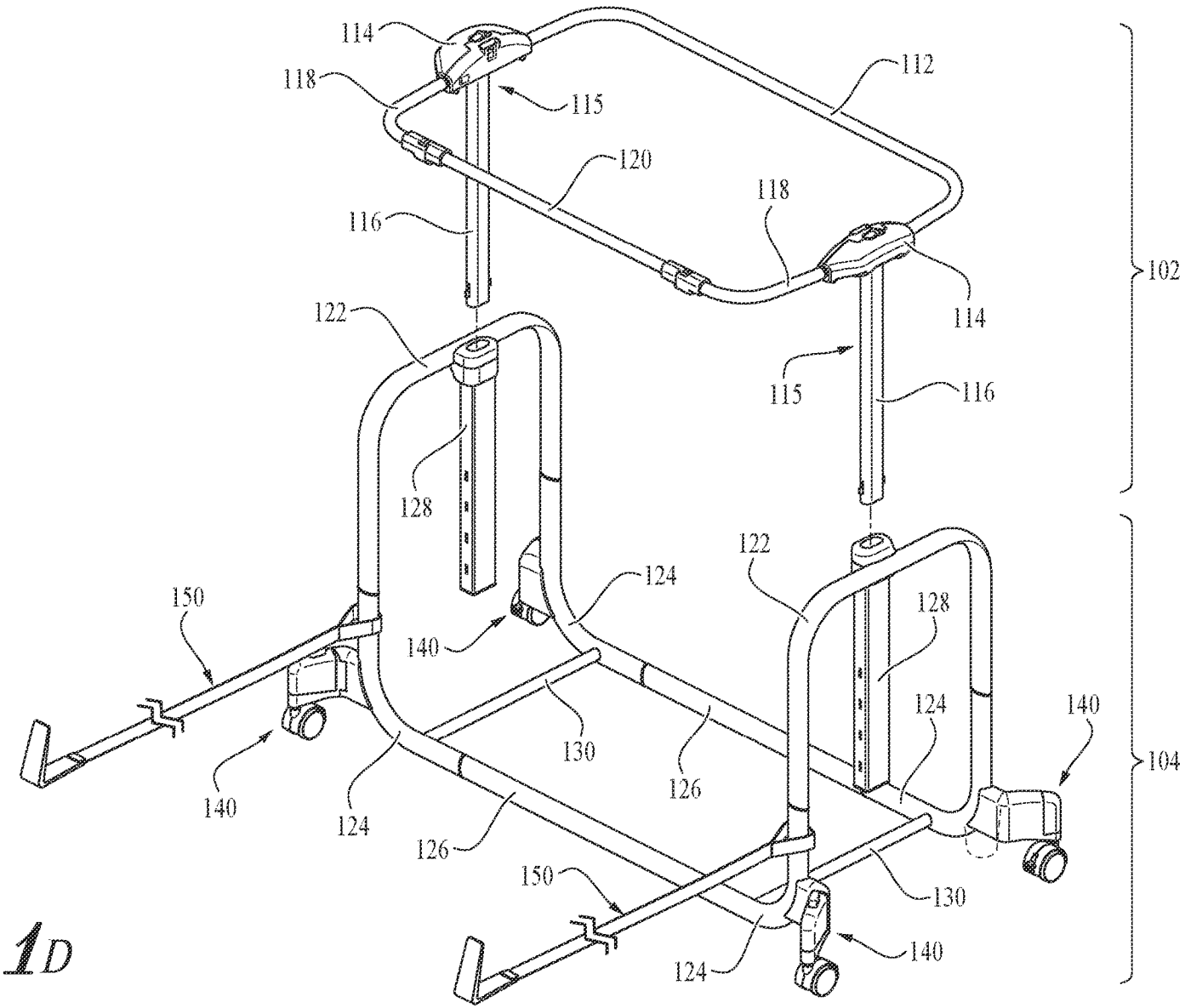
FIG. 1D shows the frame assemblies of the modular children's accessory of FIGS. 1A-1C.
Figure 5A:
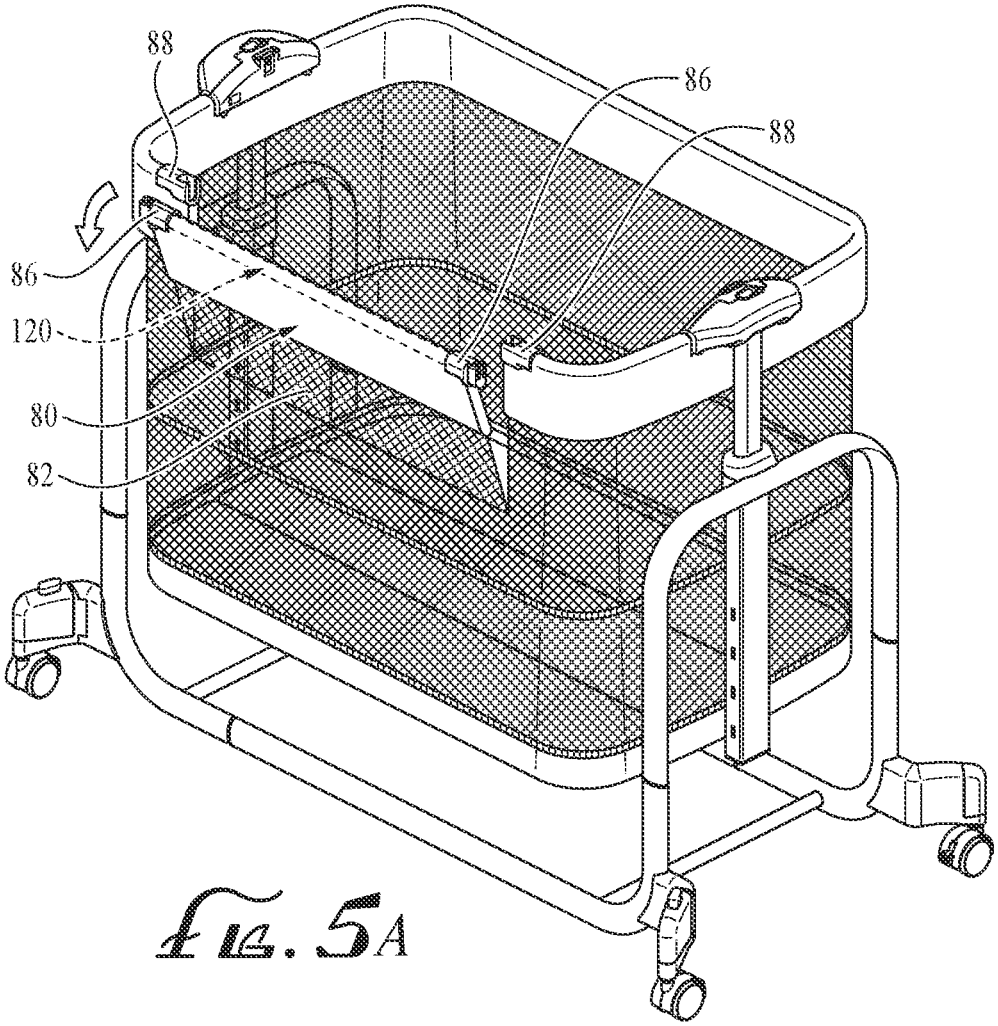
FIGS. 5A-5B show an example method of operating an enclosure flap of a child containment portion of a children's accessory according to example embodiments of the present disclosure.

FIG. 1D shows the structural frame of the modular children's accessory 100 comprising the top and base frame assemblies 102, 104. The top frame assembly 102 comprises a pair of T-shaped height-adjust support columns 115, each of the height-adjust support columns comprising a lateral grip portion 114 and an upright column portion 116 extending transversely from the grip portion. In example embodiments, the height-adjust support members 115 are spaced laterally apart and are connected by a U-shaped rear rail member 112 horizontally arranged and extending between the grip portions 114 in a first direction. The height-adjust support columns 115 are further connected by an assembly of horizontally arranged L-shaped front rail members 118 and a detachable front rail segment 120 between the grip portions 114 in a second direction opposite the first direction. As shown in FIGS. 1D and 5A, the detachable rail member 120 comprises frame couplings 86 configured for releasable engagement with frame couplings 88 of corner rails 118.

The lower frame assembly 104 comprises two base end portions connected by a central connecting portion. In example embodiments, each off the base end portions includes an inverted U-shaped side frame member 122, front and rear L-shaped corner base members 124, a height-adjust support sleeve 128, and hinging wheel assemblies 140. Each of the side frame members 122 comprise two upright legs spaced laterally apart and connected by a lateral crossmember extending between the upper ends of the upright legs. The front and rear corner base members 124 are connected to the lower, free ends of the upright legs of the inverted U-shaped side frame member 122. Moreover, the height-adjust support sleeve 128 is connected to the lateral crossmember of the side frame member 122, the height-adjust support sleeve 122 preferably extending transversely from about a central point along the lateral crossmember and oriented substantially parallel to the upright legs of the side frame member.

Figure 3B:
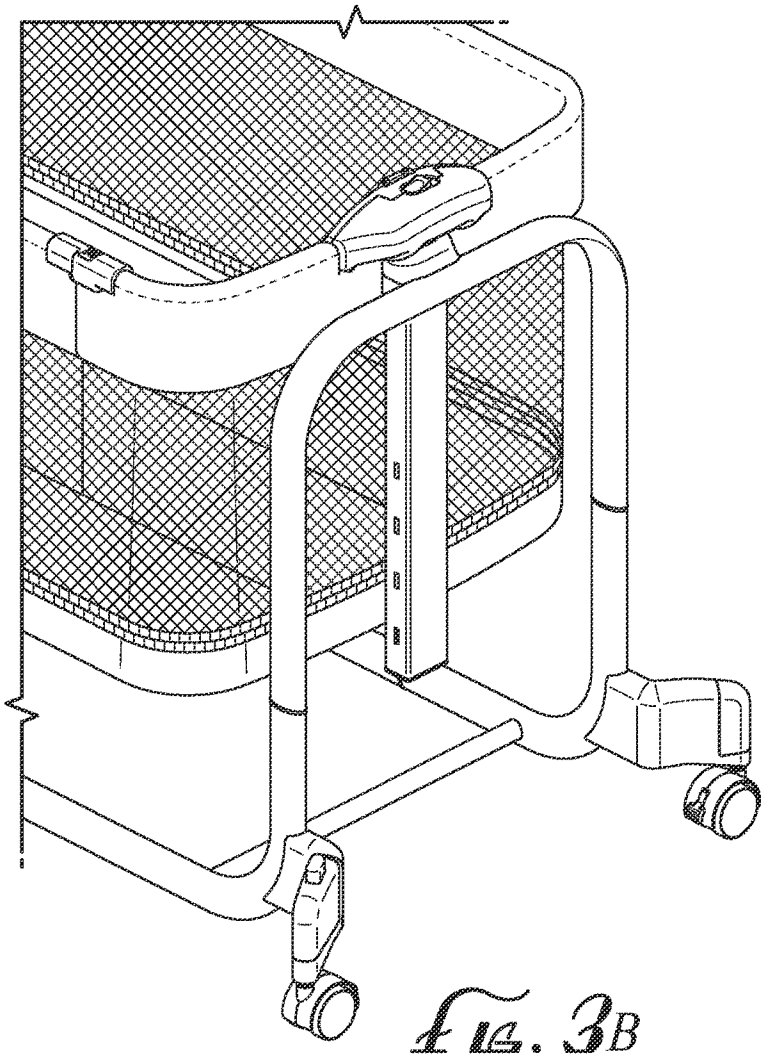
FIGS. 3A-3B show an example method of adjusting the height of a children's accessory according to an example embodiment of the present disclosure.
Figure 3A:
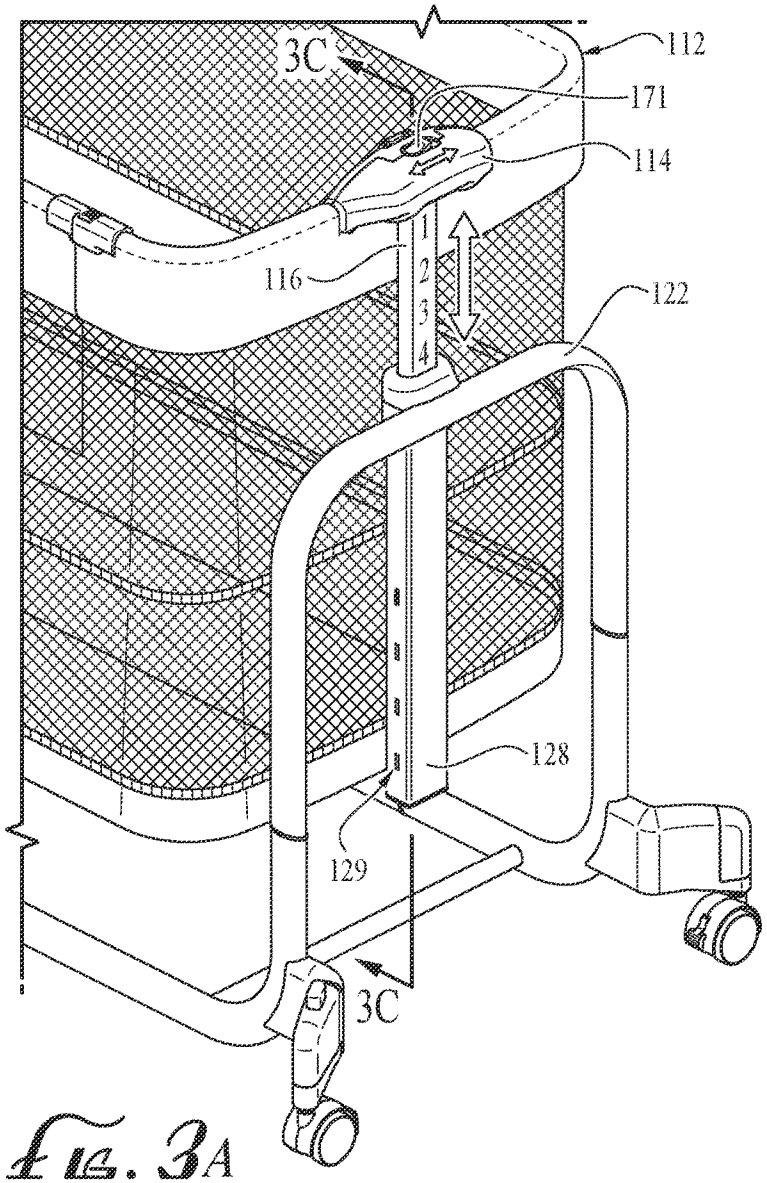
Figure 3C:
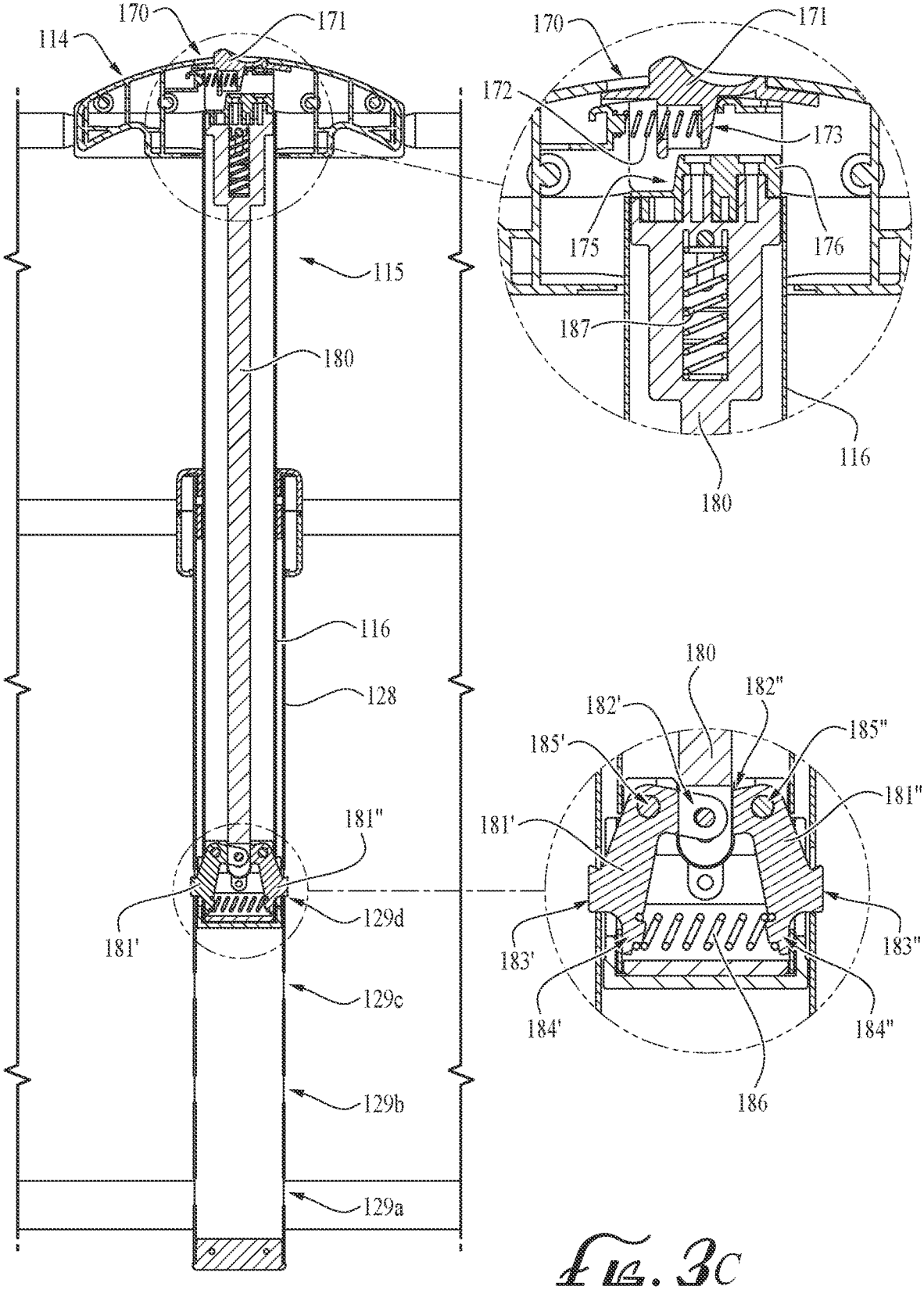
FIG. 3C-3D show detailed views of a height adjustment mechanism of the children's accessory of FIGS. 3A-3B.
Figure 3D:
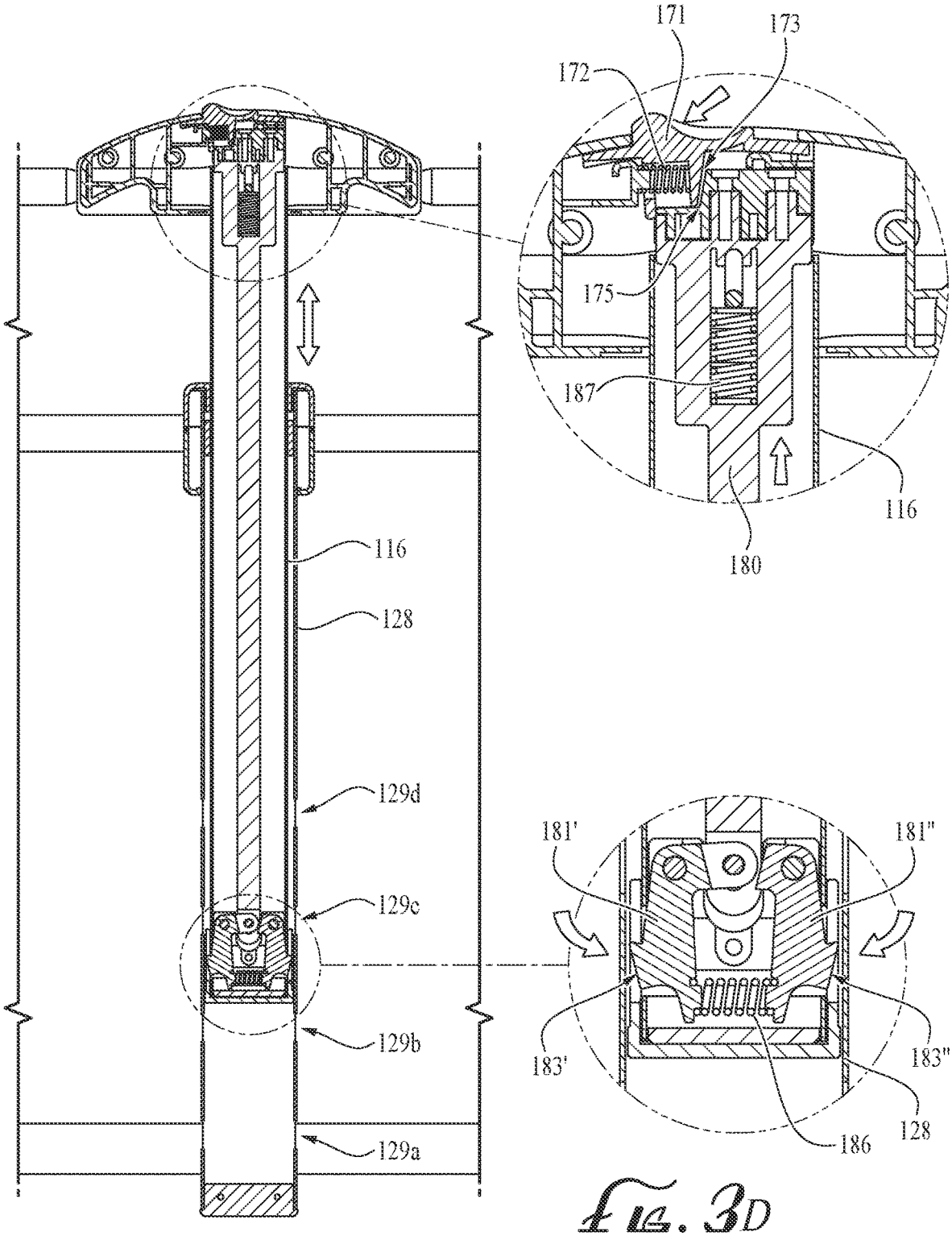

According to example embodiments, the height-adjust support sleeves 128 are hollow and are configured for receiving and engaging the upright portions 116 of the height-adjust support columns 115. For example, in example embodiments, upright column portions 116 can be lowered or inserted into support sleeves 128 wherein the support columns 116 are slidably movable therein. The height-adjust support columns 115 include an operable locking or engagement mechanism which can be used to lock the position of the support columns 115 at a number of predetermined height marks or points in the form of apertures 129 along the support sleeves 128. In depicted embodiments, as best shown in FIGS. 3C and 3D, the height-adjust support sleeves include four predetermined height positions 129*a*-129*d* wherein height position 129*a* is the lowest height and 129*d* is the highest height.

As shown in FIG. 1D, the base end portions are connected by a central connecting portion. In example embodiments, the central connecting portion comprises front and rear lower connectors 126 wherein the front lower connector 126 is secured between the front corner base members 124 and the rear lower connector 126 is secured between the rear corner base members 124. In example embodiments, the lower frame assembly 104 further includes one or more base crossbars 130 extending between the front and rear corner base members 124 and/or between the front and rear base connectors 126. According to example embodiments, various components of the upper and lower frame assemblies 102, 104 described herein are coupled to one another by friction fit, snap couplings, screws, bolts and/or other fasteners or attachment means.

Having described details of the structure of the children's accessory 100, details of its operation and features will now be described with respect to FIGS. 2A-6D. According to example embodiments of the present disclosure, children's accessory 100 includes one or more adjustable features, systems, and/or components to accommodate the different purposes and modes of use to accommodate the different stages of child development. Indeed, example modes of adjustment and/or reconfiguration of the accessory 100 include: releasably securing accessory 100 to and from for example a parental bed or another furniture (see FIGS. 2A-2E); increasing or decreasing the height of the containment portion by raising or lowering the upper frame assembly 102 relative to the lower frame assembly or support surface (see FIGS. 3A-3B); increasing or decreasing the depth D of the containment portion 90 by lowering or raising the floor of the containment 90 relative to its upper rim (see FIGS. 4A-4C); opening (lowering) or closing (raising) the bedside sleeper flap 80 (see FIG. 5A-5B); and/or locking or unlocking one or more of the hinge wheel assemblies 140 (see FIGS. 6A-6D).

Figure 2A:
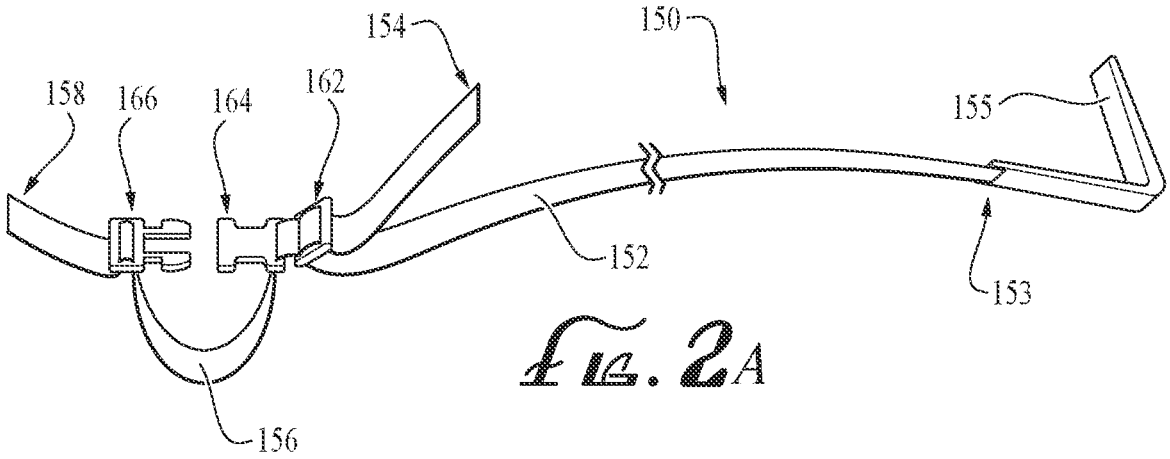
FIG. 2A shows an example embodiment of a bedside securing strap according to the present disclosure.
Figure 2B:
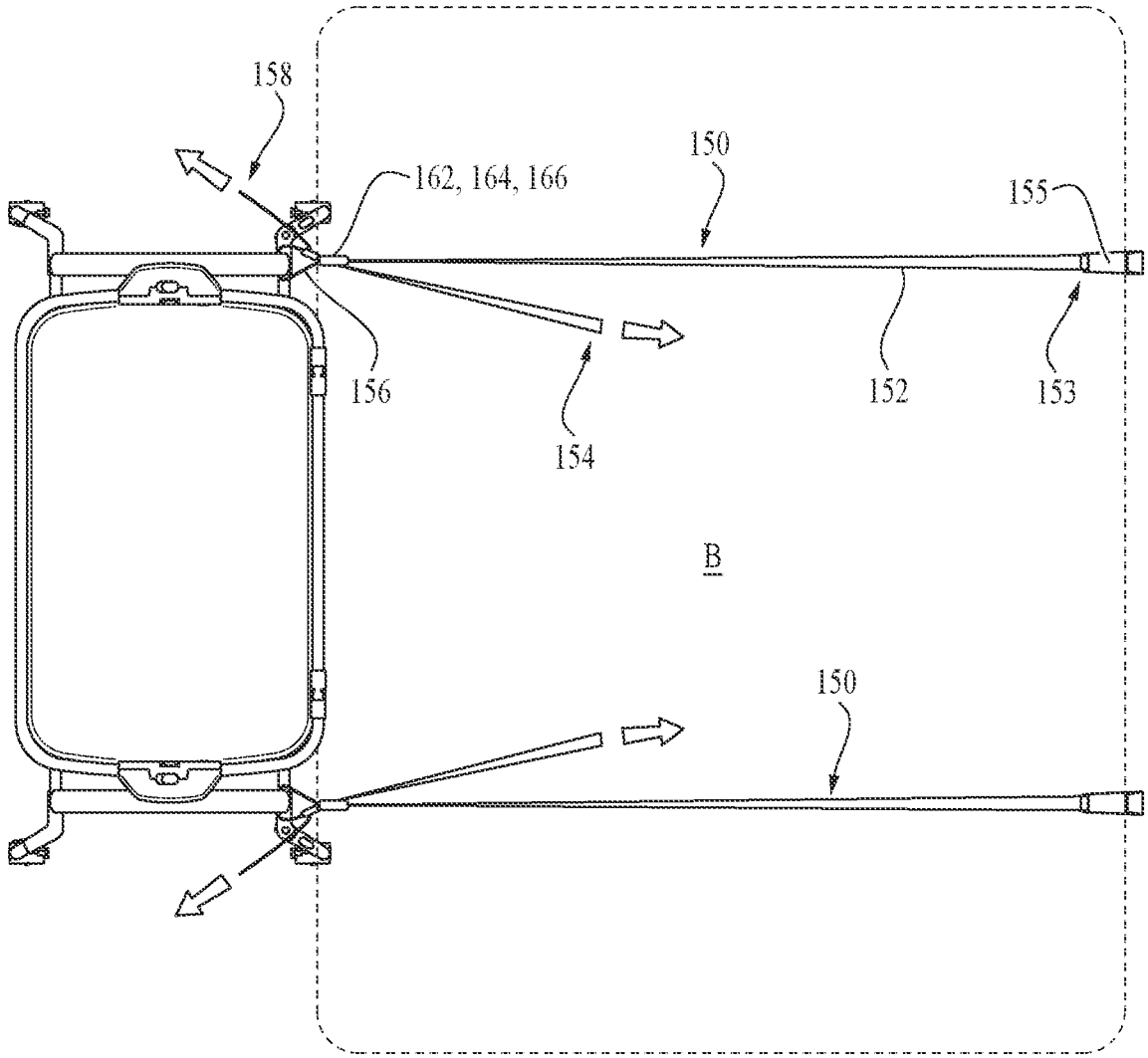
FIG. 2B shows an example method of securing a bedside sleeper to a bed according to the present disclosure.
Figure 2C:
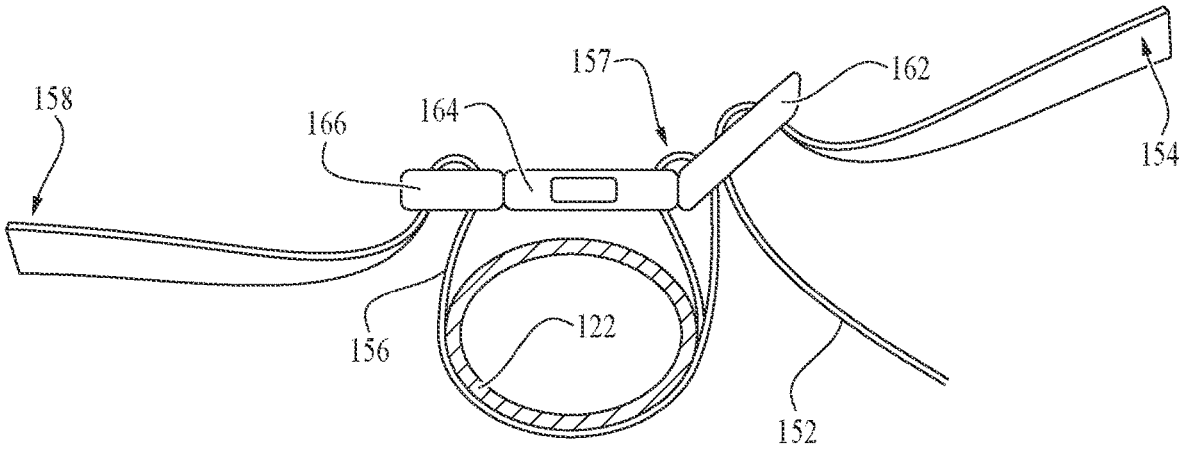
FIG. 2C shows a detailed view of a portion of the bedside securing strap of FIG. 2A secured around a portion of a bedside sleeper frame.

For example, FIGS. 2A-2E show the manner in which the children's accessory 100 may be secured against a side of, for example, a parental bed B using one or more bedside securing straps. As shown in FIG. 2A, a securing strap 150 comprises a first portion for securing the securing strap to, for example, a parental bed B and a second portion for securing the securing strap to the accessory 100. In example embodiments, the first portion of the securing strap 150 comprises a first, bed strap or belt 152 having first and second ends 153, 154. At its first end 153, the bed strap 152 includes an anchor or catch member 155 secured thereto. As shown in FIG. 1C, the anchor 155 is configured to catch or hook onto edges or corners of mattresses. According to example embodiments, the anchor 155 is preferably L-shaped to work with both mattress/boxspring and mattresses/platform bed combinations. However, the anchor may comprise other suitable shapes, profiles and forms.

The second portion of the securing strap 150 comprises a second, frame strap or belt 156 having first and second ends (157, 158), a tri-glide buckle 162, and a side-release buckle or clip including a male clip portion 166 and female clip portion 164. At its first end 157, the second, frame strap 156 features a loop 157. In example embodiments, the female clip portion 164 and tri-glide buckle 162 are secured to the loop 157. The male clip portion 166 is provided at some point along the second strap 156 between the loop 157 and the second free end 158. In example embodiments, the male clip portion 166 is configured for releasable engagement with the female clip portion 164. Moreover, the first portion of the securing strap 150 is secured to the second portion by threading the second end 154 of the first belt 152 through the tri-glide buckle 162.

In example modes of use, such as for example in the bedside sleeper configuration, one or more (preferably two) securing straps 150 may be used to secure the children's accessory 100 to a side of the parental bed. The placement of the securing straps 150 may vary depending on the configuration of parental bed. For example, where the parental bed comprises a mattress B' on top of a box spring B", the securing straps 150 are preferably passed between the mattress and the box spring (see FIG. 1C). On the other hand, where the parental bed includes a mattress placed directly on top of a bed frame or foundation, the securing straps 150 are preferably passed between the mattress B and the bed frame or foundation (see FIG. 2B). According to example modes of use, the first and second portions of the securing straps 150 can be connected together prior to use. Alternatively, the second portion (including male and female side-release clip portions 164, 166; tri-glide buckle 162; and frame belt 156) can be connected to the free end 154 of the bed belt 152 after the bed belt 152 has been passed under the parental mattress. In either mode of use, the anchors 155 are preferably pulled securely against the side of the parental mattress opposite the child accessory 100.

Once the securing straps 150 are passed under the parental mattress with the anchor 155 securely resting on one side of the parental mattress, the second portion of the securing straps 150 can be secured to the children's accessory 100. In example modes of use, the securing straps 150 are secured to the children's accessory 100 by engaging the male side-release clip 166 to the female side-release clip 164 around at least some portion of the structural frame of the accessory 100 (see for example FIG. 2C). Preferably, the securing straps 150 are secured to the upright portions of side frame 122 or corner base members 124 (see FIG. 1D).

With both the first portion of the securing straps 150 securely anchored to the parental bed and the second portion of the securing strap securely looped around a portion of the structural frame of the accessory 100, accessory 100 can be pulled closer to the parental bed by shortening or tightening the securing straps by pulling ends 154 of the bed belts 152 and/or ends 158 of the frame belts 156. In example modes of use, pulling on ends 154 of the bed belts in a first direction (e.g., in the direction of the adult bed B) provide greater "rough" adjustments to the overall length of the securing straps 150, whereas pulling the ends 158 of the frame belts 156 in a second direction generally opposite the first direction (e.g., away from the adult bed B) provide smaller or "finer" adjustments to the overall length and thereby to the positioning of the bedside sleeper relative to the adult bed. Moreover, because the second portions of the securing straps are situated apart from the parental bed and are configured to be tightened by pulling in a direction away from the parental bed, ends 158 of the frame belts 156 are generally more readily accessible, making it easier to make final adjustments without having to move or lift the parental mattress. Accordingly, the first portions of the securing straps 150 (including bed straps 152 and anchor 155) can be manipulated or adjusted initially to make large, quick adjustments to the overall length of the securing straps 150, and the second portions of the securing straps 150 (including male and female side-release clip portions 164, 166; tri-glide buckle 162; and frame belt 156) can be manipulated or adjusted subsequently to make any final "fine-tuning" adjustments to the securing straps.

Figure 2D:
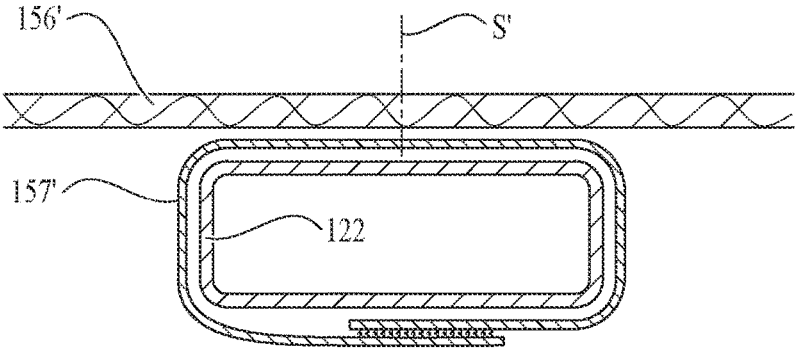
FIGS. 2D-2E show detailed views of portions of bedside securing straps according to other example embodiments of the present disclosure secured around a portion of a bedside sleeper frame.
Figure 2E:
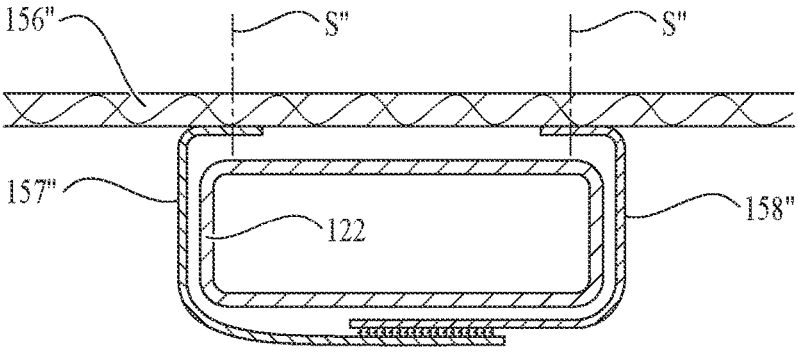

In other example embodiments, the securing straps 150 may include other means for securing the securing straps to the structural frame. For example, FIG. 2D shows a flexible strap or harness 157' secured to a frame belt 156' at an attachment point S' resulting in two free, opposing ends. In the depicted embodiment, the opposing free ends of harness 157' include hook-and-loop fasteners or other reclosable fasteners. In example modes of use, the two ends of the harness 157' may be looped around for example a side frame member 122 and secured to one another forming a closed loop around the frame member. In another example embodiment, the securing straps 150 may comprise two separate bands 157" and 158" individually secured to the frame belt 156" about separate attachment points S", as shown in FIG. 2E. At their free ends, bands 157" and 158" comprise cooperative reclosable fasteners, such as for example hook-and-loop fasteners, for releasable engagement with one another. In example modes of use, the free ends of bands 157" and 158" may be looped around for example a side frame member 122 and secured to one another forming a closed loop around the frame member. Notably, the use of two separate bands to secure the side frame member 122 lessens the likelihood of the side frame member and the closed loop from shifting during use.

FIGS. 3A-3D show the manner in which the height of the upper frame assembly 102 and the child containment portion 90 may be raised ($H_1$) and lowered ($H_2$) relative to the floor or other supporting surface. In example embodiments, the lower frame assembly 104 is configured to rest on a support surface and provide a stable base on which to support the other components of the children's accessory 100, including the upper frame assembly 102 and child containment portion 90. As described above, the lower frame assembly includes a pair of upright tubular height-adjust sleeves 128 fixed to the base end portions (or more specifically the side frame members 122). In example embodiments, the height-adjust columns 115 of the upper frame assembly 102 are received in the channels of the height-adjust sleeves 128. Moreover, the height-adjust columns 115 include a system of internal component operable to engage and disengage a set of predetermined locking apertures 129*a*-129*d* provided along the sides of the height-adjust sleeves 128, as shown in FIGS. 3C and 3D.

As shown in FIG. 3C, the height-adjust columns 115 include a drive shaft 180, a first L-shaped locking finger 181', a second L-shaped locking finger 181", a locking spring 186, and a drive spring 187. The drive shaft 180 comprises an elongated body extending from a top end to a bottom end. The drive shaft 180 further comprises at its top end a head portion 176 with a notched section 175. The transition between the head portion 176 and the notched section 175 is sloped. The drive spring 187 is secured to the top end of the drive shaft 180 and biases the drive shaft 180 up towards its top end along its longitudinal axis (parallel to its axis of elongation). The first and second L-shaped locking fingers 181' and 181" are pivotally secured to the height-adjust column 115 at pivot points 185' and 185", respectively. The first and second locking fingers 181' and 181" comprise first extensions 182' and 182", respectively, extending in a first direction and second extensions 184' and 184", respectively, extending in a second direction substantially transverse to the first direction. The first extensions 182' and 182" are pivotally connected to the bottom end of the drive shafter 180. The second extensions 184' and 184" are connected by the locking spring 186 secured therebetween, the locking spring biasing the ends 184' and 184" apart from one another. The first and second locking fingers 181', 181" further comprise locking protrusions 183' and 183", respectively, which are configured to retractably engage locking apertures 129*a*-129*d* provided along the height-adjust sleeves 128 during use.

Moreover, the height-adjust columns 115 also include a user-operable sliding actuator 171 provided in the lateral grip portion 114. The sliding actuator 171 is slidably operable within aperture or slot 170. The sliding actuator 171 further comprises a base portion 173 with a sloped forward surface configured to engage the sloped surface of the drive shaft head 176.

In example modes of use, the height-adjust columns 115 are operable between a height locked state and height adjusting state. Generally, in the height locked state, locking protrusions 183' and 183" are extended outwardly and engaged in any one of the locking apertures 129, the interaction between the locking protrusions and the locking aperture preventing the height-adjust columns 115 from being moved relative to the height-adjust sleeves 128. In the height adjusting state, locking protrusions 183' and 183" are retracted and disengaged from the locking apertures 129. Without interference between the locking protrusions and the locking apertures, the height-adjust columns 115 can be moved up or down within the height-adjust sleeve channels.

According to example modes of use, the height-adjust columns 115 are transitioned between the height locked state and height adjusting state by moving the sliding actuator 171. More specifically, in the height-locked state (as shown in FIG. 3C), the base portion 173 of sliding actuator 171 is positioned over the head portion 176 of the drive shaft 180 whereby the drive shaft 180 is forced down towards its bottom end. The lowered position of the drive shaft causes the second extensions 184', 184" of the first and second fingers 181', 181" to spread out, driving protrusions 183' and 183" outwardly through apertures 129.

To increase or decrease the height of the upper frame assembly 102 relative to the lower frame assembly 104, the height-adjust columns 115 are disengaged from the height-adjust sleeves 128 by sliding or moving the sliding actuator 171 over so that the base portion 173 is no longer in interference with the head portion 176 of the drive shaft 180. See FIG. 3D. As the base portion 173 clears the head portion 176 and slides into the notched portion 175 of the drive shaft 180, the drive shaft 180 is moved up driven by the drive spring 180. The upward movement of the drive shaft causes the first finger 181' to rotate counter-clockwise and the second finger 181" to rotate clockwise about pivot pins 185' and 185", respectively, and thereby causing protrusions 183' and 183" to retract from the respective locking apertures. Once the sliding actuator 171 let free, the slide spring 172 biases the sliding actuator 171 back to its neutral position (i.e., position of the sliding actuator in the height locked state). As the sliding actuator 171 moves back to its neutral position, interference between the sloped surfaces of the base portion 173 of the sliding actuator and the sloped surface of the head portion 176 causes the drive shaft 180 to transition back to its lower position causing the second extensions 184' and 184" to spread out once again. As the height-adjust column 115 is moved up or down, the protrusions 183' and 183" once again engage the next locking aperture 129 and thereby locks the upper frame assembly to the height corresponding with the newly engaged locking aperture.

Figure 4A:
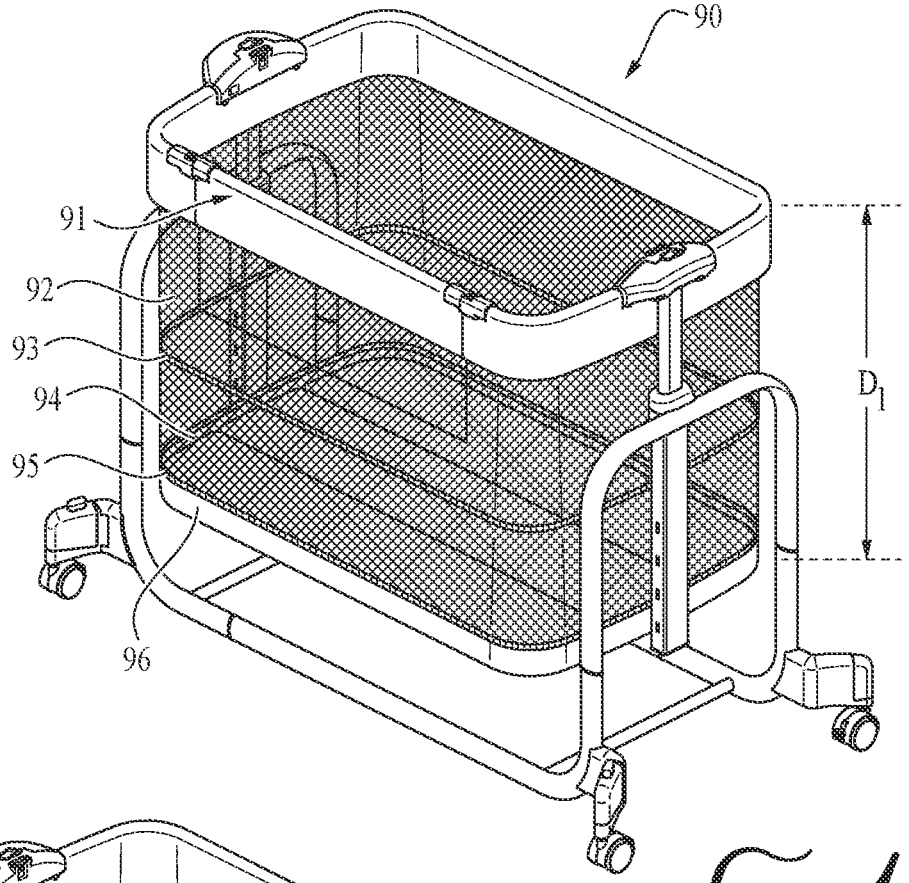
FIGS. 4A-4C show an example method of adjusting the depth of a child containment portion of a children's accessory according to example embodiments of the present disclosure.
Figure 4B:
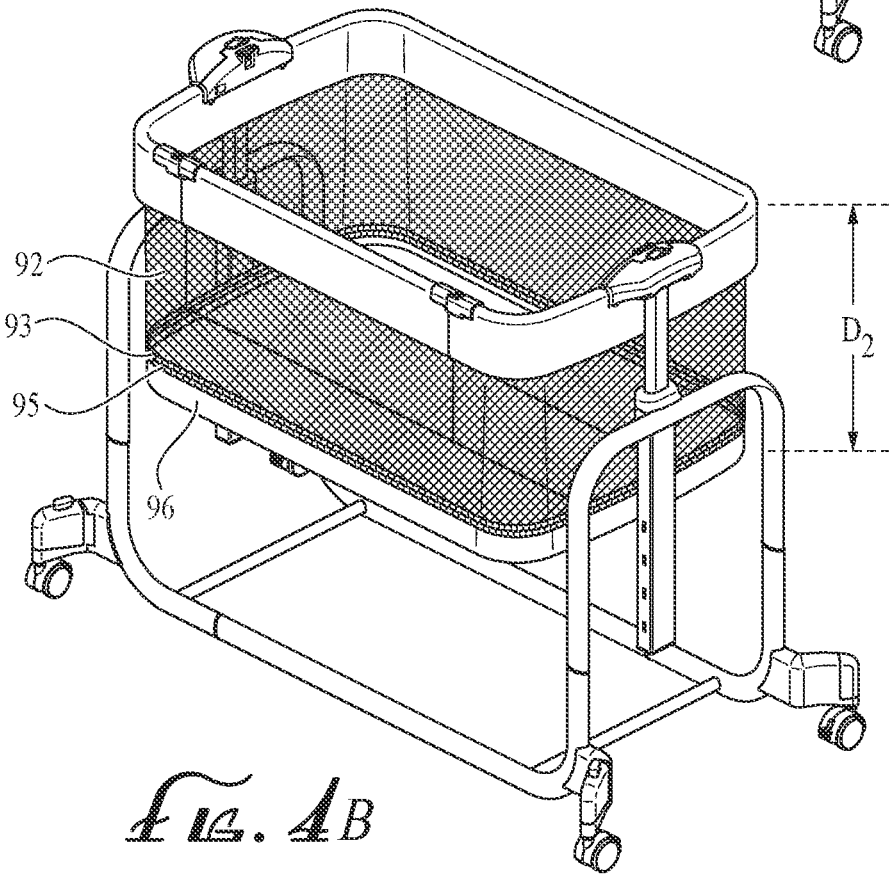
Figure 4C:
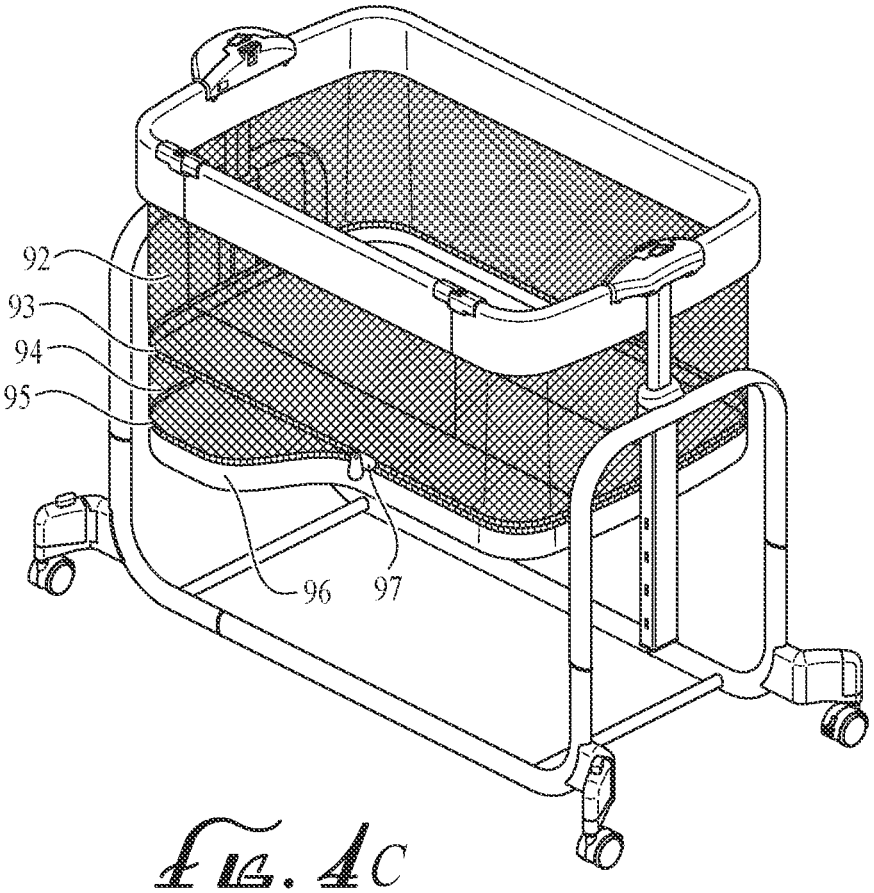

FIGS. 4A-4C show the manner in which the depth D of the containment portion 90 can be increased or decreased. According to example embodiments, the depth D of the containment portion 90 can be adjusted by lowering or raising the floor or bottom 96 of the containment 90 relative to its upper rim or opening. As shown in FIG. 4A, the child containment portion 90 comprises a top opening or rim 91, an upper portion 92, a lower portion 94 and a floor or bottom 96. Between the upper and lower portions 92, 94, child containment portion 90 includes a first, upper engagement element 93 and, between the lower portion 94 and floor 96, child containment portion includes a second, lower engagement element 95. Both the first, upper engagement element 93 and the second, lower engagement element 95 are generally arranged around the perimeter or exterior surface of the child containment portion 90. Generally, the first and second engagement elements 93, 91 are configured for releasable engagement with one another and may include zippers, hook-and-loop strips, pairs of button-and-hook/loop elements, snap fasteners, and/or other suitable releasable engagement mechanisms. In depicted embodiments, the first and second engagement elements 93, 95 are cooperative elements of a zipper closure. For example, as shown in FIGS. 4A-4C, the first engagement element 93 is a first side of a zipper closure spanning the periphery between the upper containment portion 92 and lower containment portion 94. Similarly, the second engagement element 95 is a second side of a zipper closure arranged around the periphery of the floor 96 of the containment portion 90.

As shown in FIGS. 4A-4C, the depth of the containment portion 90 can be increased or decreased by either engaging or disengaging the second zipper side 95 to or from the first zipper side 91. For example, the depth of the containment portion 90 can be decreased ($D_2$) by raising the floor of the containment portion 90 up to the first zipper side 93 and fastening the second zipper side 95 to the first zipper side 93, as shown in FIG. 4B. Conversely, the depth of the containment portion 90 can be increased ($D_1$) by disengaging the second zipper side 95 from the first zipper side 93 and allowing the floor 96 of the containment portion 90 to fall or be lowered, as shown in FIG. 4B. FIG. 4C shows the typical transition of the containment portion 90 between the bassinet and playard configurations wherein the first and second zipper portions 93, 95 are engaged or disengaged to or from one another using a zipper slider 97.

In other example embodiments, the child containment portion 90 may comprise two or more cooperative engagement elements defining additional positions in which the floor of the containment portion may be locked or cinched. In other words, the child containment portion 90 may comprise additional cooperative engagement elements so the depth of containment portion 90 can be adjusted between three or more predetermined depths. In still other example embodiments, the floor of the child containment portion 90 may be lowered until the floor 96 rests on the support surface (e.g., ground, floor, etc.).

Figure 5B:
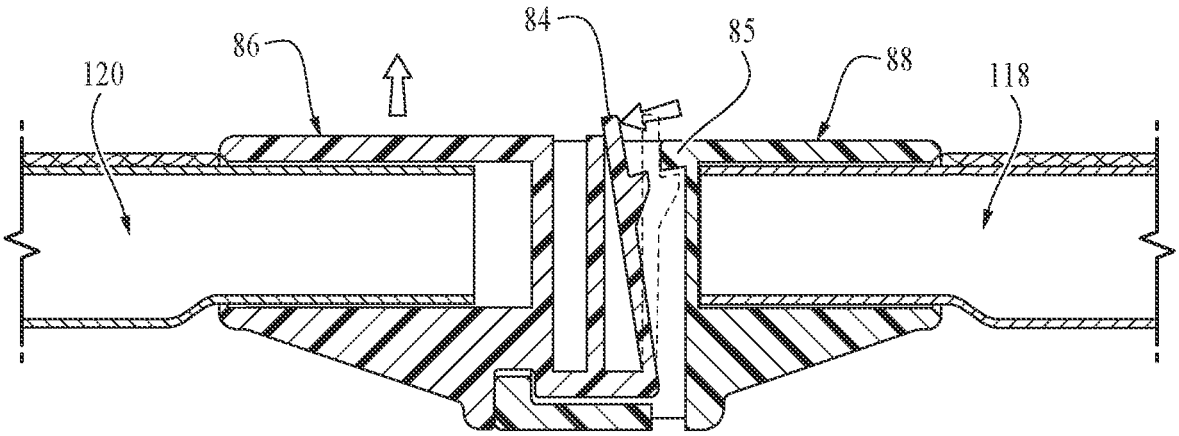

FIGS. 5A and 5B show the manner in which the detachable bedside flap or panel 80 can be lowered and raised to provide an additional point of access to the child or infant inside the child containment portion during use. Particularly in the bedside sleeper configuration, it is preferable to have access to the child via a side of the containment portion and without having to reach over the sidewalls.

In example embodiments, the soft-goods liner of the child containment portion 90 is detachably secured to the upper frame assembly 102 or, more specifically, the rear rail member 112, corner rail members 118 and detachable front rail member 120. In example embodiments, the bedside sleeper flap 80 portion of the soft-goods liner is configured to align specifically with the detachable front rail member 120 of the upper frame assembly 102. The detachable rail member 120 comprises frame couplings 86 configured for releasable engagement with frame couplings 88 of corner rails 118. In example modes of use, the detachable rail member 120 can be detached or isolated from the corner rails 118 by deflecting fingers 84 of frame couplings 86 away from the catch 85 of the frame couplings 88. With fingers 84 deflected, the detachable rail member 120 can be lifted out of engagement with the corner rails 118. In exampled embodiments, fabric 82 of the bedside sleeper flap 80 comprises sufficient elasticity or stretch to lift the detachable rail member 120 out of engagement with the frame couplings 88. Subsequently, the bedside sleeper flap 80 can be lowered or moved away. To close or restore the flap, the detachable rail member 120 is reengaged to frame couplings 88 whereby fingers 84 are caused to reengage the catches 85 of the frame couplings 88. In some example embodiments, the bedside sleeper flap 80 may also include zippers, or similar engagement elements, securing the sides of the flap 80 to the rest of the soft-goods liner of the child containment portion.

FIGS. 6A-6D show a hinged wheel assembly 140 mounted to an external side of a leg or other frame member of the accessory 100. In example embodiments, the hinged wheel assembly 140 includes a lock and release actuator 146 configured for foot-operated engagement and release to lock and release the wheel's swiveling and/or rolling operation. In example embodiments, the hinged wheel assembly 140 comprises an outwardly extending flange or outrigger structure including a first hinge portion 142 hingedly connected to a second hinge portion 144. In example embodiments, the first hinge portion 142 is fixed to the corner base frame member 124. The second hinge portion 144 is hingedly connected to the first hinge portion 142 and is configured to pivot about axis A.

Positioning the hinged wheel assemblies 140 externally or outwardly from the frame provides additional stability and clearance for lowering the containment portion 90 of the accessory 100. For example, if the hinged wheel assemblies 140 were positioned beneath the frame of children's accessory 100, it could prevent lowering of the containment portion 90 to a position adjacent the floor any lower than the top of hinged wheel assemblies. By contrast, the external positioning of the caster wheel 148 on the outrigger assembly allows the containment portion of the accessory 100 to be lowered to or adjacent the floor or other supporting structure, for example to a position resting on lower crossbars 130 of the lower frame assembly 104.

Figure 6A:
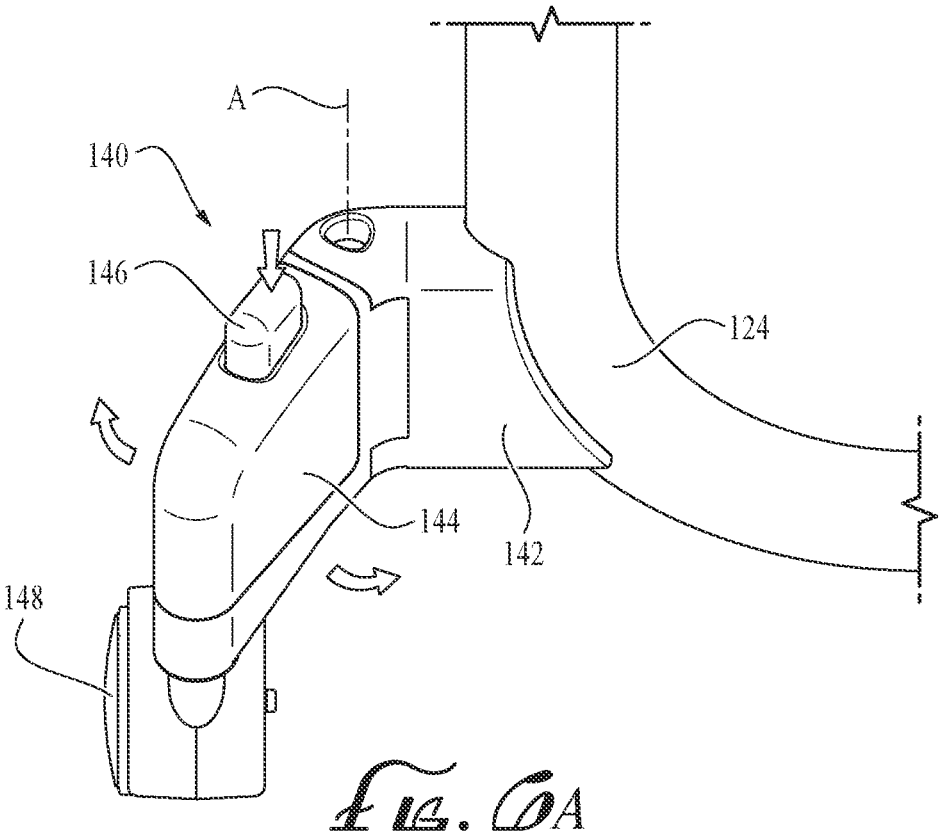
FIGS. 6A-6D show detailed views of a hinging wheel outrigger assembly according to example embodiments of the present disclosure.
Figure 6B:
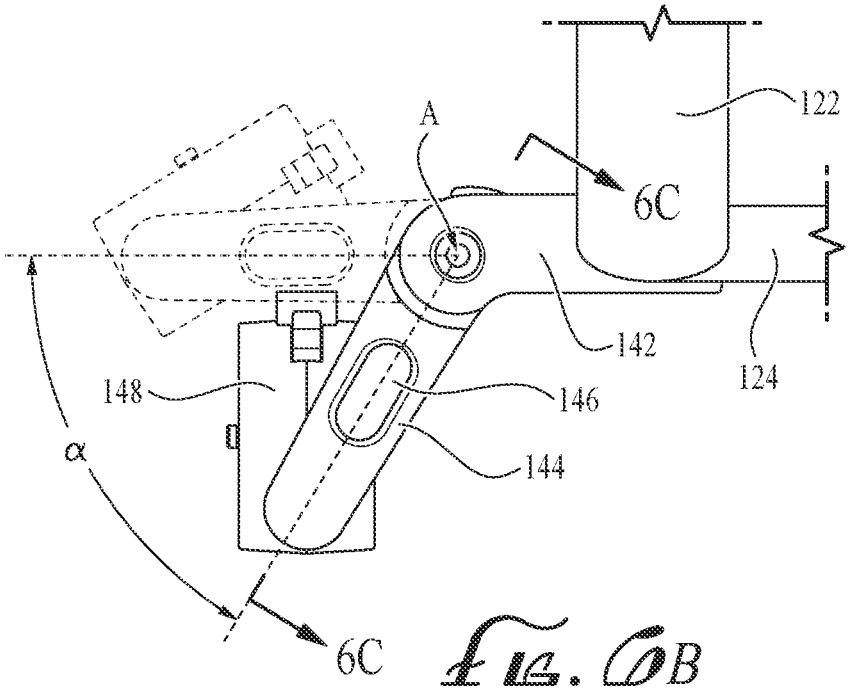
Figure 6C:
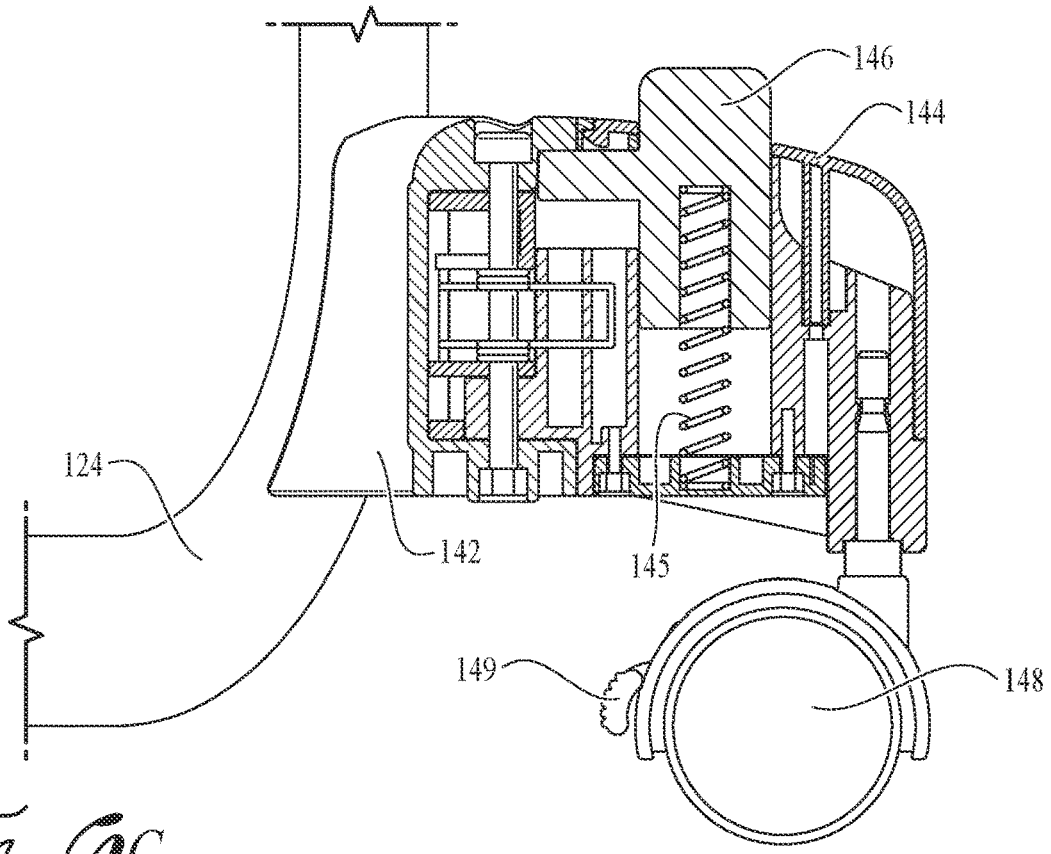
Figure 6D:
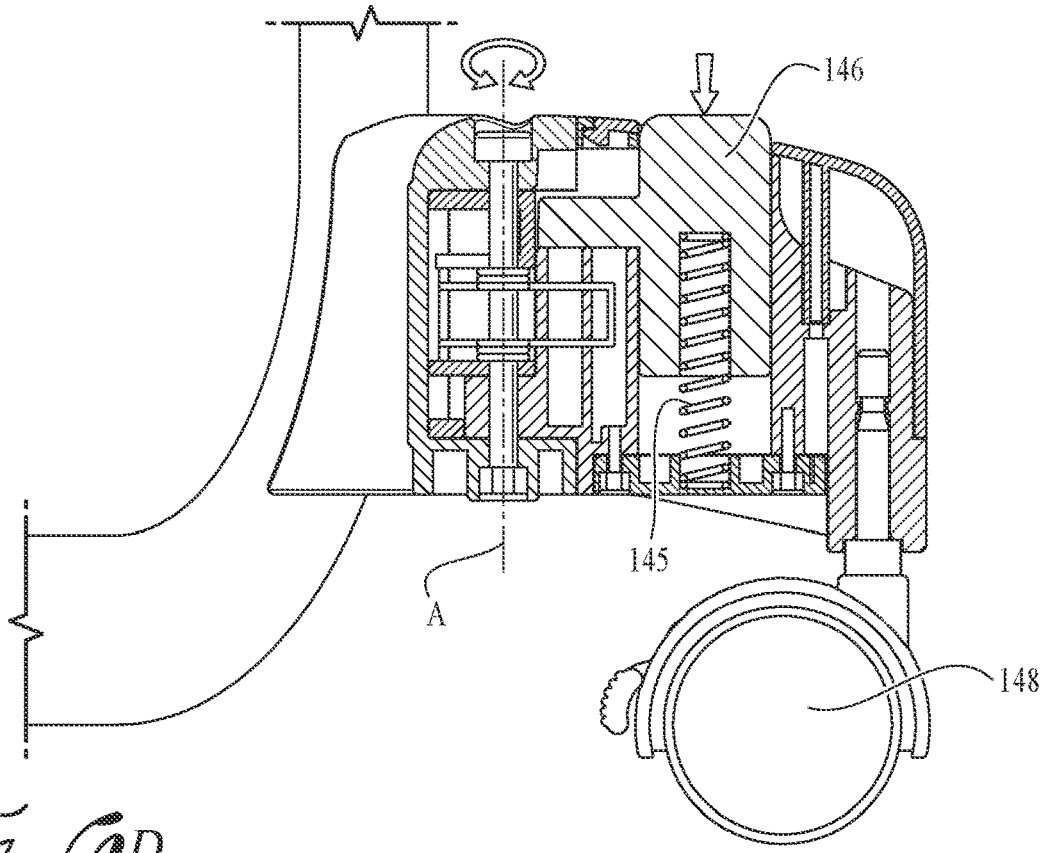

Moreover, as shown in FIG. 6B, the wheel 148 and outrigger assembly are angularly offset, for example at an oblique offset angle $\alpha$ of about 45° from the longitudinal axis of the frame element to which it is attached, for improved stability. In example embodiments, the outrigger or hinge wheel assembly 140 includes a spring-loaded hinge, biased to retain the assembly at the angularly offset orientation in its neutral state; and allowing the assembly to pivot or flex to a retracted position, for example aligned with the frame element to which it is attached, upon contact or abutment with another object such as a bed frame when the accessory 100 is configured for use as a bedside sleeper. By allowing the second hinge portions 144 and wheels 148 to move inboard when moved against a bed frame or other object, the hinged wheel assemblies 140 maintain stability while allowing the accessory 100 to be placed into close or immediately adjacent proximity to the object.

In example embodiments, wheels 148 are preferably caster wheels pivotally mounted to the hinged outrigger flange. Additionally, wheels 148 may further comprise releasable locking mechanisms 149 configured for user actuation to selectively allow or prevent rolling of the wheels.

Figure 7:
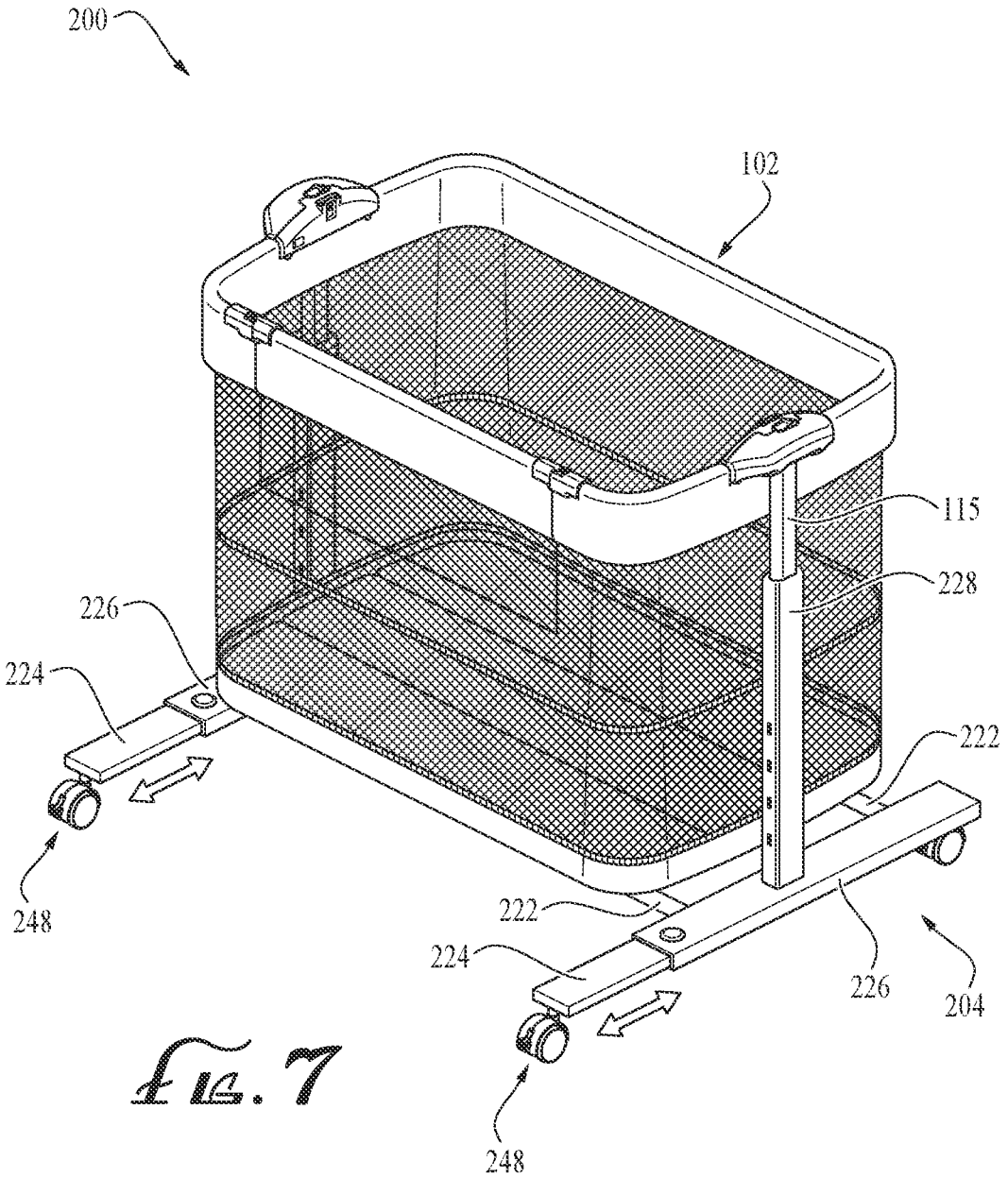
FIG. 7 shows another example embodiment of a children's accessory according to the present disclosure.

FIGS. 7-10 show children's accessories according to other example embodiments of the present disclosure. For example, FIG. 7 shows a children's accessory 200 with an upper frame assembly 102 and a child containment portion 90 as described above but comprising a different lower frame assembly 204. The lower frame assembly 204 comprises a pair of base frame members 226 connected by a pair of crossbar members 222. The base frame members 226 comprise telescoping inner base frame members 224 slidably engaged therein. The children's accessory 200 further comprises a plurality of wheels 248 attached to the telescoping inner base frame members 224 at the front of the children's accessory and wheels attached to the base frame members 226 at the rear of the children's accessory. Moreover, the children's accessory 200 comprises a pair of height-adjust sleeves 228 extending transversely from the base frame members and configured for receiving and slidably supporting the height-adjust columns 115 and the upper frame assembly (and the corresponding child containment portion) over the lower frame assembly 204. The telescoping base frame members allow the base to be extended for increased stability when used apart from other objects, and to retract to allow the accessory to be moved close to and against another object such as an adult bed when used in a co-sleeper mode.

Figure 8A:
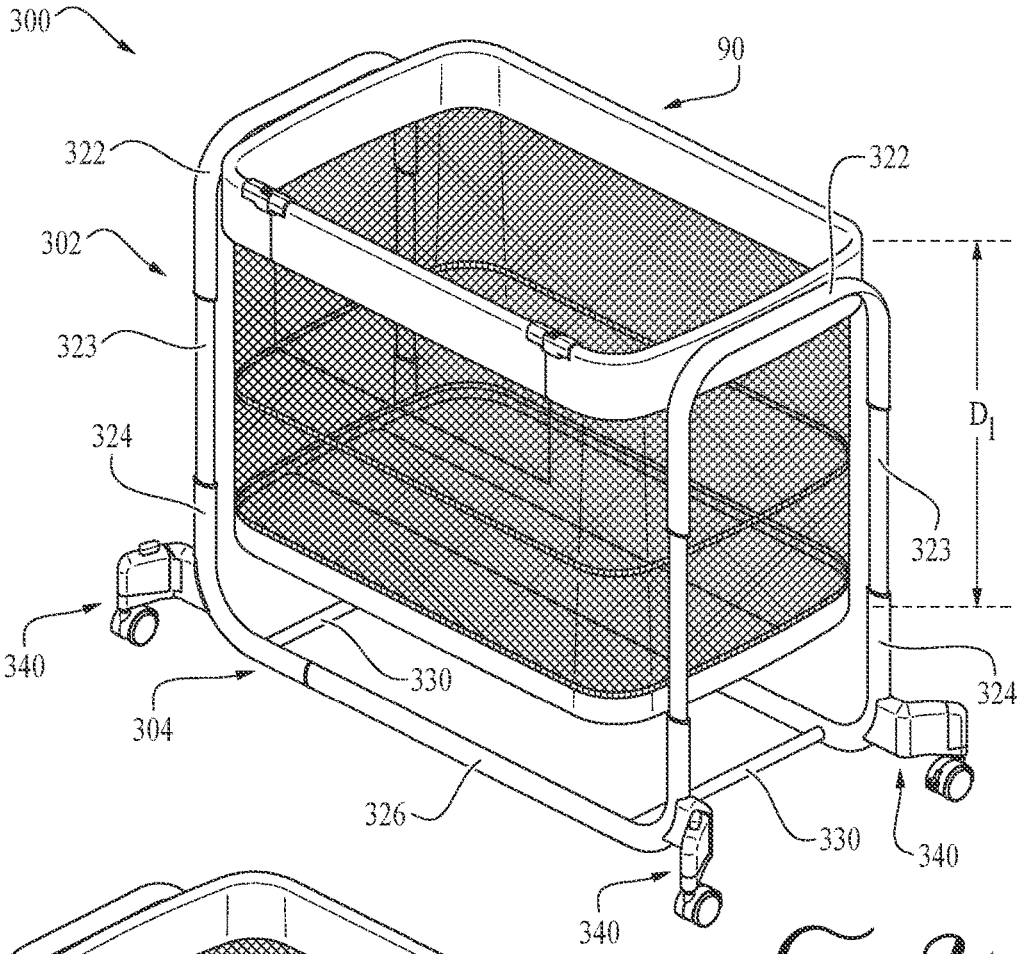
FIGS. 8A-8B show yet another example embodiment of a children's accessory according to the present disclosure.
Figure 8B:
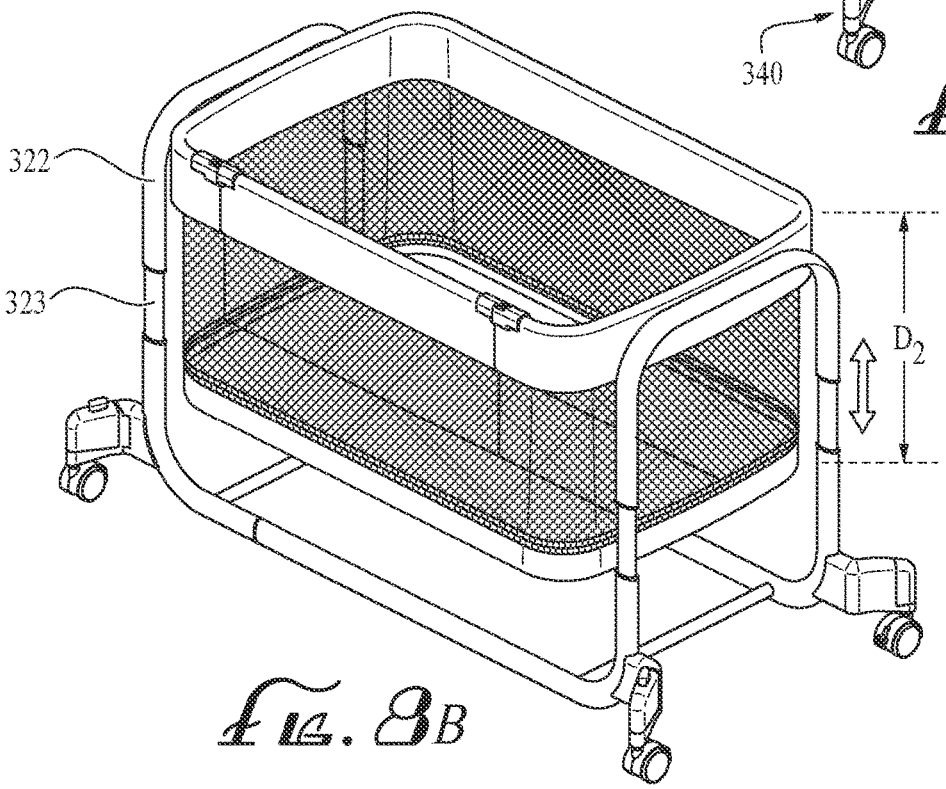

FIGS. 8A and 8B show a children's accessory 300 according to another example embodiment of the present disclosure. Children's accessory 300 comprises a lower frame assembly 304 including two base end portions 302 connected by a central connection portion 326. Each base end portion 302 comprises an inverted U-shaped side frame 322, side inner frames 323, and lower corner frame members 324. In the depicted embodiment, the upright portions of the side frames 322 and lower corner frame members 324 are configured to slide over the side inner frames 323. For example, the inverted U-shaped side frames 322 may be adjusted between a first, lower height and a second, higher height relative to the support surface (i.e., floor or ground) by sliding the side frames 322 up and down over side inner frames 323.

The children's accessory 300 further comprises a child containment portion 90 (as described above) secured at its sides to the side frames 322. Moreover, the children's accessory 300 also comprises hinge wheel assemblies 340 secured to the lower corner frame members 324. The outrigger or hinge wheel assemblies 140 include a spring-loaded hinge, biased to retain the assembly at the angularly offset orientation in its neutral state; and allowing the assembly to pivot or flex to a retracted position, for example aligned with the frame element to which it is attached, upon contact or abutment with another object such as a bed frame when the accessory 300 is configured for use as a bedside sleeper.

In example modes of use, the height of the children's accessory 300 can be increased and decreased by telescoping the side frames 322 over the side inner frames 323. Additionally, the child containment portion 90 may further comprise one or more engagement elements configured for increasing ($D_1$) and decreasing ($D_2$) the depth of the child containment portion as described above.

Figure 9:
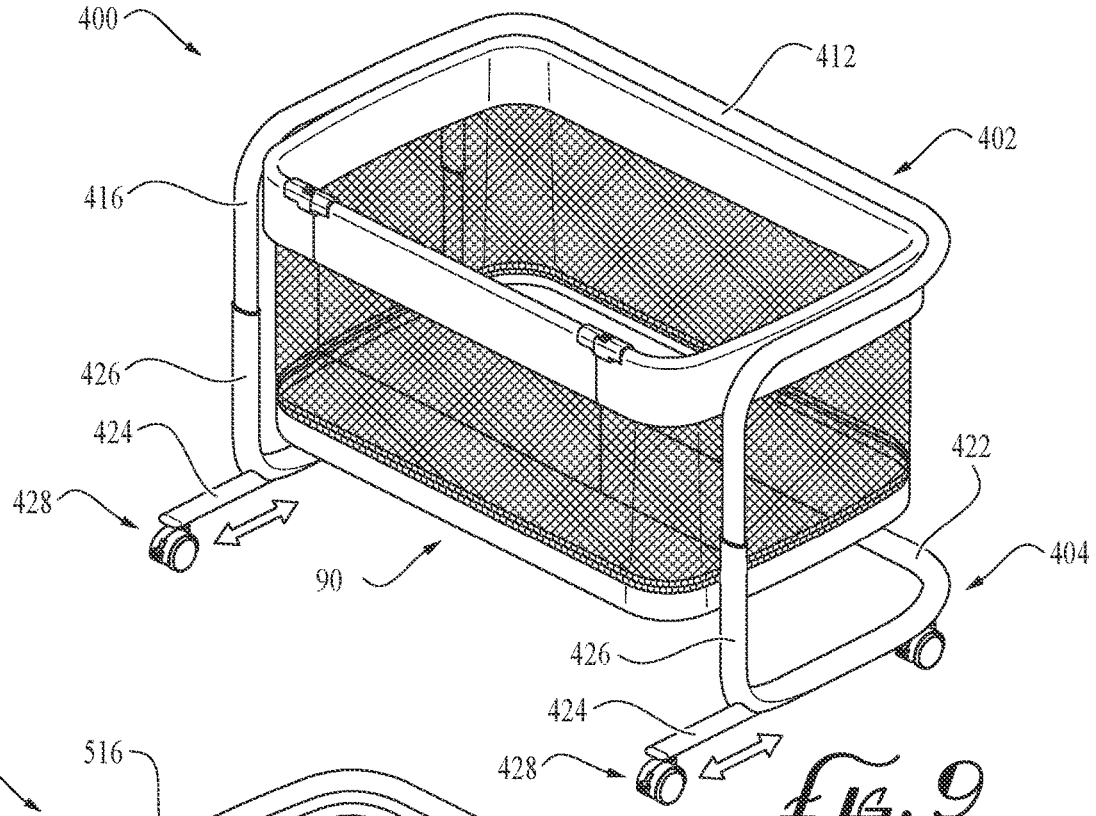
FIG. 9 shows still another example embodiment of a children's accessory according to the present disclosure.

FIG. 9 shows a children's accessory 400 according to another example embodiment of the present disclosure. The children's accessory 400 comprises a child containment portion 90 secured at its sides to an upper frame structure 402. The upper frame structure 402 is slidably engage to a lower frame structure comprising an upright portion 426 and a U-shaped base frame 422 arranged horizontally over a support surface. The children's accessory 400 further includes horizontal telescoping base frame members 424 slidably engaged with the lower frame structure 404. The horizontal telescoping frame members 424 may be extended or shortened as needed or desired. The children's accessory 400 further comprises a plurality of wheels 428 attached to the telescoping base frame members 424 at the front of the children's accessory 400 and wheels attached to the base frame 422 at the rear of the children's accessory.

In example modes of use, the height of the children's accessory 400 can be increased and decreased by telescoping the upright portions 416 of the upper frame structure 402 relative to the upright portions 426 of the lower frame structure 404. Additionally, the child containment portion 90 may further comprise one or more engagement elements configured for increasing and decreasing the depth of the child containment portion as described above.

Figure 10:
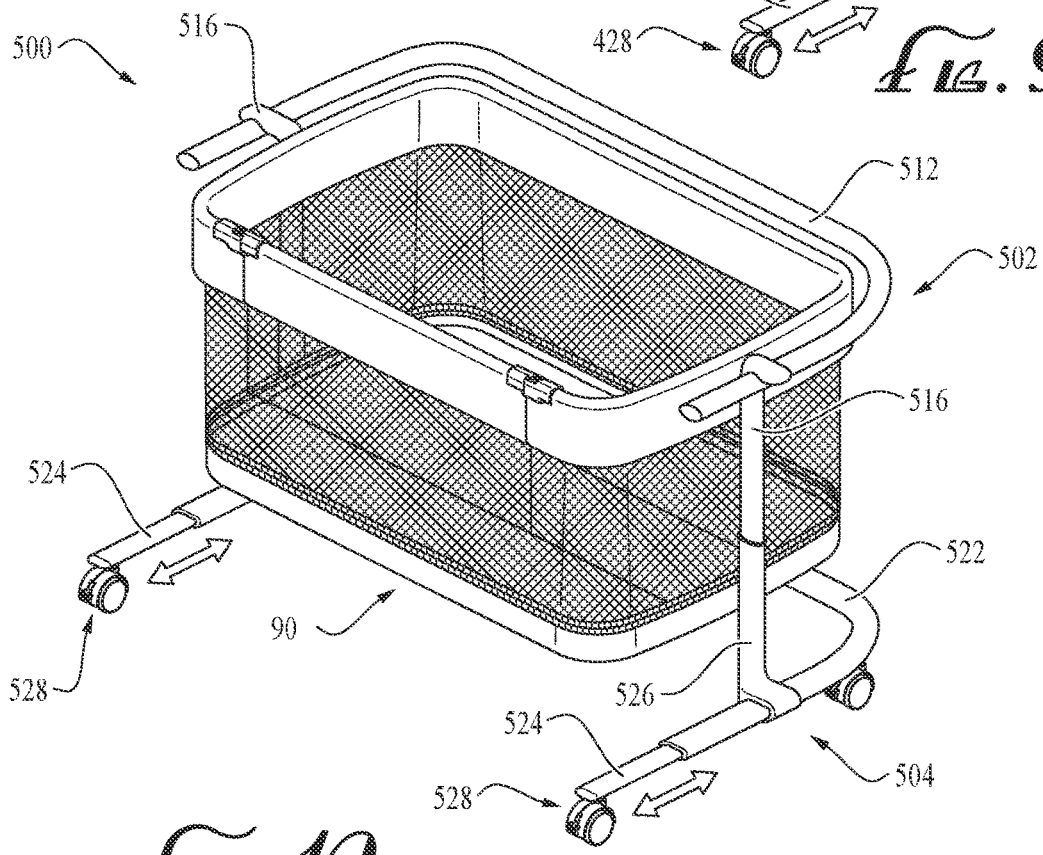
FIG. 10 shows another example embodiment of a children's accessory according to the present disclosure.

FIG. 10 shows a children's accessory 500 according to another example embodiment of the present disclosure. The children's accessory 500 comprises a child containment portion 90 secured at its sides to an upper frame structure 502. The upright portions 516 of the upper frame structure 502 is slidably engage to a lower frame structure 504 comprising upright portions 526 and a U-shaped base frame 522 arranged horizontally over a support surface. The children's accessory 500 further includes horizontal telescoping base frame members 524 slidably engaged with the lower frame structure 504. The horizontal telescoping frame members 524 may be extended or shortened as needed or desired. The children's accessory 500 further comprises a plurality of wheels 528 attached to the telescoping base frame members 524 at the front of the children's accessory 500 and wheels attached to the base frame 522 at the rear of the children's accessory.

In example modes of use, the height of the children's accessory 500 can be increased and decreased by telescoping the upright portions 516 of the upper frame structure 502 relative to the upright portions 526 of the lower frame structure 504. Additionally, the child containment portion 90 may further comprise one or more engagement elements configured for increasing and decreasing the depth of the child containment portion as described above.

While the invention has been described with reference to example embodiments, it will be understood by those skilled in the art that a variety of modifications, additions and deletions are within the scope of the invention, as defined by the following claims.

What is claimed is:

1. A child support furniture comprising:

a lower frame assembly with a fixed height and comprising at least one channel, and an upper frame assembly comprising at least one frame post, wherein the at least one frame post of the upper frame assembly is slidably engaged in the at least one channel of the lower frame assembly, and wherein the upper frame assembly is adjustable between a first height and a second height relative to the lower frame assembly; and a child enclosure unit detachably secured to the upper frame assembly, wherein the child enclosure unit is adjustable between a first depth and a second depth different from the first depth, and wherein the child enclosure unit comprises at least one first engagement element and at least one second engagement element, and wherein the child enclosure unit comprises the first depth when the at least one first engagement element is coupled to the at least one second engagement element and the child enclosure unit comprises the second depth when the at least one first engagement element is detached from the at least one second engagement element.

2. The child support furniture of claim 1, further comprising a wheel assembly comprising a hinged outrigger flange coupled to a frame member of the accessory and at least one wheel coupled to the hinged outrigger flange.

3. The child support furniture of claim 2, wherein the hinged outrigger flange is spring biased toward and oblique angular offset orientation relative to the frame member.

4. The child support furniture of claim 2, wherein the at least one wheel is a caster wheel pivotally mounted to the hinged outrigger flange.

5. The child support furniture of claim 2, wherein the at least one wheel comprises a releasable locking mechanism configured for user actuation to selectively allow or prevent rolling of the wheel.

* * * * *